US008480146B2

(12) United States Patent
Seale

(10) Patent No.: US 8,480,146 B2
(45) Date of Patent: Jul. 9, 2013

(54) STRAP AND METHOD FOR UTILIZING

(76) Inventor: Glenn Seale, Fairhope, AL (US)

( * ) Notice: Subject to any disclaimer, the term of this patent is extended or adjusted under 35 U.S.C. 154(b) by 1543 days.

(21) Appl. No.: 12/001,042

(22) Filed: Dec. 7, 2007

(65) Prior Publication Data

US 2008/0087700 A1 Apr. 17, 2008

Related U.S. Application Data

(63) Continuation-in-part of application No. 10/810,006, filed on Mar. 26, 2004, now abandoned.

(60) Provisional application No. 60/459,426, filed on Mar. 28, 2003.

(51) Int. Cl.
*A45F 3/02* (2006.01)
*B65D 33/06* (2006.01)

(52) U.S. Cl.
USPC ..... 294/152; 294/158; 294/159; 224/925; 248/97

(58) Field of Classification Search
USPC ..... 294/95, 97, 137, 143, 149, 152–154, 294/158, 159, 171; 211/113, 168, 171, 85.15, 211/85.29, 71.01; 224/311, 606, 250, 925; 206/554; 248/95, 97, 99, 100, 124.1, 121, 248/125.9, 126, 127; 383/7, 8, 9, 10
See application file for complete search history.

(56) References Cited

U.S. PATENT DOCUMENTS 1,904,725 A * 4/1933 Gerhold ..... 211/41.2
2,392,011 A * 1/1946 Stringer ..... 211/171
3,919,740 A * 11/1975 Scherb ..... 24/198
4,094,414 A * 6/1978 Thiot et al. ..... 211/101
4,228,834 A * 10/1980 Desnick ..... 383/13
4,387,873 A * 6/1983 Pavlo et al. ..... 211/113
4,694,503 A * 9/1987 Hydorn ..... 383/12
4,830,385 A * 5/1989 Wallick et al. ..... 280/35
4,896,853 A * 1/1990 Nyzen ..... 248/97
4,919,368 A * 4/1990 Garrett ..... 248/121
5,022,538 A * 6/1991 Richmond et al. ..... 211/113
5,127,538 A * 7/1992 Bach ..... 248/101
5,507,542 A * 4/1996 Eden ..... 294/143
5,551,379 A * 9/1996 Hart ..... 119/771
5,678,842 A * 10/1997 Hook et al. ..... 280/646
5,680,943 A * 10/1997 Robley ..... 211/171
5,735,494 A * 4/1998 Kurk ..... 248/97
5,765,789 A * 6/1998 Ryon et al. ..... 248/97
6,104,304 A * 8/2000 Clark et al. ..... 340/664
6,386,491 B1 * 5/2002 Bissett ..... 248/121
(Continued)

*Primary Examiner* — Paul T Chin

(57) ABSTRACT

A loading device using multiple handles with straps or loops dispensable sequentially to at least one but preferably two loading arms is shown for loading and closing bags with handles. While one loading arm may be used, two or more loading arms are preferable and these arms rotating about a stand above a loading and unloading area is preferable. A support which moves with the loading arms to support the bags as they sit on the loading arm. The multiple arms may be dispensed as a plurality of sequential straps and handles that are connected together so they can be fed steadily onto the loading arms on either side as they are used. The device is specifically designed to be used in conjunction with a bag loader so that the user may load the bags and then put them over the straps on one or more rack arms and then close and lift the bags utilizing the handle running through either a loop formed by the straps or an opening provided in a strap for that purpose.

18 Claims, 32 Drawing Sheets

U.S. PATENT DOCUMENTS 6,447,037 B1 * 9/2002 Crouch ..... 294/149
6,923,356 B2 * 8/2005 Reynolds ..... 224/585
7,243,825 B2 * 7/2007 Weisenfeld ..... 224/311
7,258,352 B2 * 8/2007 Odgers ..... 280/47.28
7,458,488 B2 * 12/2008 Bass et al. ..... 224/162
7,828,703 B1 * 11/2010 Boesch ..... 482/93
2002/0116796 A1 * 8/2002 Wills ..... 24/306
2009/0033110 A1 * 2/2009 Fragale ..... 294/26
2010/0314425 A1 * 12/2010 Oldfield ..... 224/264
2011/0248057 A1 * 10/2011 Schmitz ..... 224/275

* cited by examiner

STRAP AND METHOD FOR UTILIZING

PRIORITY CLAIM

This patent is a Continuation In Part of Provisional Patent Ser. No. 60/459,426 filed Mar. 28, 2003 and Utility patent application Ser. No. 10/810,006 filed Mar. 26, 2004 now abandoned.

BACKGROUND OF INVENTION

1. Field of Invention

The invention applies to securing loads

2. Prior Art

The inventive concept is a mechanism to hold a strap from either end over an arm so that bags may be loaded over the strap to hold a plurality of handles so that they may be dispensed, sequentially or otherwise. One or more arms, proximately locating a strap holder to a bag loader. There is a user location where a user may reach items to be bagged, bag the items, remove the loaded bag from a bag loader and place those over the strap over the arm for holding the strap and thereafter lift the collected bags using the strap.

The primary aspect of the invention is its design in order to hold both bags and straps by the bag handle over the strap.

The prior art shows holders and bag holders but no device which holds a plurality of bags over a removable strap capable of sealing the bags as they are removed from the support arm and in particular at a check out location.

The U.S. Pat. No. 1,904,725 shows an arm type member 11 having on one end thereof a clip comprised of spring members 9 and 10.

This is designed to hold a plate on the arm resiliently so that the plate is supported on one end by arm 7 and on the other end by clip 9.

The difference between this invention and the present invention are several, but utilizing the broadest claim, there is no mechanism for supporting a strap both at the clip end by indentations 9 and 10 and on the opposite end of the arm 11 which is not designated but which is the end where the bags would be added if a strap were held in place and it was envisioned to use this for holding bags over the strap as shown in the present invention.

The "holding means for holding the at least one strap means first end to the first front end and the strap means second end to the first rear end" is shown in the several views of the patent.

Another striking difference lies in the failure of the prior art to provide a strap means juxtaposed with the bag loader and dispenser of the type shown.

Yet another difference is having a means for dispensing more than on strap sequentially. There is no loader in the prior art for dispensing a plurality of straps.

Yet another difference from the prior art is the failure to provide a means for holding a strap capable of looping in on itself between the rack arm front end and the rack room rear end.

The U.S. Pat. No. 5,678,842 does not provide any mechanism for securing a strap at either end no do they disclose the adjusted position of a loading means for the bags shown in FIGS. 18 and 19, nor does it allow the strap to loop on itself to lift the bags from the loading arm. Any device which separates the bags along the arm teaches away from this device which is designed to hold several bags on a single strap over a supporting arm and to allow the strap to release the strap so it can loop together or be connected together as shown to remove the bags from the arm and hold them together.

The U.S. Pat. No. 4,830,385 is distinguishable and has none of the mechanisms for holding the strap at either end and nor does any of the prior art show a mechanism for dispensing multiple straps from a central location.

GENERAL DISCUSSION OF THE INVENTION

The invention may be generally described as a device and method for closing and joining bags having handles having a top and a bottom and a length from top to the bottom with a loaded width which device may be located proximately to a loading table and an unloading table, cash register, belt and the like found at retail outlets. A single or a plurality of strap means is important, but it is clear that if only a single strap is used, other straps would come afterward unless only a single user was to be serviced, so the invention necessarily involves a plurality of strap means. Preferably there is a box or spool (both may be referred as a spool) as a dispenser means for dispensing the plurality of strap means contained in the spool, each of said strap means comprising a first end and a second end and a strap length between the first end and second end and a closing means for closing a loop in the strap means between the first end and the second end. The use of straps in the form of loops of ropes and handles (one of the many embodiments and perhaps the least efficient) is known, but this invention takes this limited concept much further with stamped continuous straps of the types described in more detail below and used with a support means comprising at least one rack arm with a first front end and first rear end and an arm length between the first front end and the first rear end receiving at one time at least one strap length of the plurality of strap means between the at least one first end and at least on second end along the arm length and receiving at least one bag handle over the strap along the arm length.

Yet another improvement is at least one second rack arm with a second front end and second rear end and an arm length between the second front end and the second rear end receiving at least one of the plurality of strap means between the at least one second front end and at least one second rear end of the at least one second arm and receiving along the arm length above the strap length at least one second bag handle. This allows for the bags to be loaded on one arm by the cashier while the customer unloads at the other end.

The support means must be supported on some type of base and the rack arms are above the base by at least the bag length so the bags can hang, but there may be a table which rotates with the arms which supports the bottom of the bags so that heavy items like milk do not break through during the loading process.

The support means holds or is over a spool which acts as a package holding means for holding and dispensing one of the plurality of strap means lengths between the first front end and first rear end of the rack arms sequentially. In some embodiments, the rack arms would rotate 180 degrees and then back over the same arc so the spool (typically a box) may rest on the ground. In other embodiments, there is a mounting means which moves with the rack arms.

The support which holds spinning arms (one version may be fixed in place with multiple or single rack arms constantly facing the same direction) acts as a spindle for supporting the at least one rack arm first rear end and at least one second rack arm second rear end on the spindle so that the at least one rack arm is separated by a distance at least equal to the loaded width from the at least one second rack arm so the bags may be loaded on both arms, but the first rear end is separated from the second rear end on the spindle by a distance approximately equal to the fractional difference of a circle divided by the total number of rack arms attached to the spindle (with 2 rack arms 180 degrees, with 3 rack arms 120 degrees, etc) so that the device is balanced.

The spindle rotates the rack arms between the loading table and the unloading table for continuous loading and unloading. Where at least one bag support plate 117 shown in FIG. 38 is attached to the spindle and under the at least one rack arm it is preferably at a distance less than the bag length.

The designs for the strap are important, there being the need to close over the bag handles and to accomplish this and allow these to be carried, the closing means for closing the circle may be an opening defined by the strap approximately opposite the length of the strap from the handle for receiving the handle so the strap may be looped by inserting the handle into the opening.

There is a user location adjacent to the support means. Using a bag loader which is separate is important and this bag loader where the bags are initially filled (sometimes there are two for the cashier and a bagger individual, the support means further comprises at least one rack means adjacent to the user location for holding bags while they are loaded before being moved to the at least one rack arm.

The preferred embodiment allows for the stamped continuous and inexpensive plastic straps with handles, but also has a holder to take a box (which may be purchased) containing two (one for each rack arm) or more strap means of the more expensive type, comprising a loop having a first and second length and a handle attachable along the first length of the loop. While they would preferably be sold with the handle attached, the loops could be used alone as taught herein and the handle attached afterwards so that the users could bring their own handles back reducing the cost. The handles could also grasp plastic straps and could be designed to accept the plastic handles or the strap itself with the same design features taught for accepting the string.

In all embodiments, it is preferable to have a strap dispensing means at the rear end for sequentially dispensing a plurality of straps over the at least one rack arm and a separate one (even if they come from a common spool, for each separate rack arm. The plurality of strap means sequentially feeds to the at least one rack arm from a spool means for holding straps to be fed sequentially in this fashion. So that one strap pulls the following strap into place over the rack arm, the plurality of straps are connected together by a connector in the preferred embodiment. Since a strap loosely held over the rack arm would slip off, a first holding means attached to the first front end for holding the strap first end with the strap length over the rack arm length between the first front end and the first rear end. Since it is better to be held at both ends, the at least one rack arm defines a second holding means attached to the first rear end for holding the strap second end at the first rear end.

Where the strap comprises a loop frame the frame may define an opening and the first holding means holds the loop frame off of the rack arm so the handle may be inserted through a hole in the loop frame to create the loop free of the rack arm. The specific designs of these are defined in the specification in more detail.

The invention may be described as a method for loading bags having a handle capable of receiving a plurality of loaded bags on to at least one rack arm with a strap means over the rack arm for forming a loop of material through the handles of the bags comprising the steps of:

a) placing a strap means on the at least one rack arm;

b) placing at least one bag over the strap means and over the at least one rack arm;

c) forming the loop in the strap means to grasp the at least one bag;

d) lifting the at least one bag off of the at least one rack arm by the strap means.

20) The invention further comprises:

a) moving the at least rack arm and loop to a second location before lifting, that is moving these to the unloading table, which is preferably an actual table but may be an area for receiving the loaded rack arm in other embodiments.

The invention is, therefore, best described as a loading device using multiple handles with straps or loops dispensable sequentially to at least one but preferably two loading arms is shown for loading and closing bags with handles. While one loading arm may be used, two or more loading arms are preferable and these arms rotating about a stand above a loading and unloading area is preferable. A support which moves with the loading arms may be used to support the bags as they sit on the loading arm. The multiple arms may be dispensed as a plurality of sequential straps and handles that are connected together so they can be fed steadily onto the loading arms on either side as they are used. The device is specifically designed to be used in conjunction with a bag loader so that the user may load the bags and then put them over the straps on one or more rack arms and then close and lift the bags utilizing the handle running through either a loop formed by the straps or an opening provided in a strap for that purpose.

As can best be seen by reference to FIG. 1 one closing device utilizes a handle which receives one end of a loop on the left end of the handle and the other end of the loop on the right end of the handle in order to provide a carrying mechanism which is better described in more detailed below.

The length of the string is made adjustable through a variety of mechanisms, one of which being the provision of multiple string lengths which may connect to the handle, through snug knots on a single string, or by a sliding buckle.

A mechanism is provided to tighten the loop and maintain this once it has been put in place around a load or handle to be lifted.

Also taught is a specialized strap which allows the weight of the handle to be properly distributed to the person carrying the load and allows for the detachment of the handle from the shoulder support and the re-attachment so that the support may be continuously worn by the user while the handle is periodically detached.

Also taught is a method of utilizing the broad invention in conjunction with a number of other products each of which forms a combination which is a unique invention.

One combination includes handcuffs in order to provide the user with handling distance between the user and the person handcuffed as well as providing a mechanism for securing the handcuffs and thereby the individual restrained to various stationary objects and in easily releaseable fashion.

The primary use in this specification is for a collection of bags having handles and utilizes a looping handle in order to releaseably secure the collection together so that they may be more easily carried and so they may be set down without spilling even if the bags are otherwise without structural support.

The handles have several modifications including describing an opening through which a flag may be secured and an opening through which an additional securing mechanism (such as a nail) may be utilized in order to permanently or removably attach the device in the end of lumber for providing a signal while the lumber is transported. This may also apply to loads other than lumber such as ladders and the like.

In addition an alternative looping mechanism whereby a second set of ropes is attachable in conjunction with the first set of ropes allows for different types of loads to be carried.

It is therefore one object of the invention in order to provide for a loading mechanism which allows for bags to come off a rack and be individually loaded and to be grouped together on a single carrying string or strap and to be removed together by looping the string or strap. These carrying arms may be made to swing towards the location of a shopping cart in order to allow easier removal by the user of the combined loads.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EXEMPLARY EMBODIMENTS

Figures 1, 2:
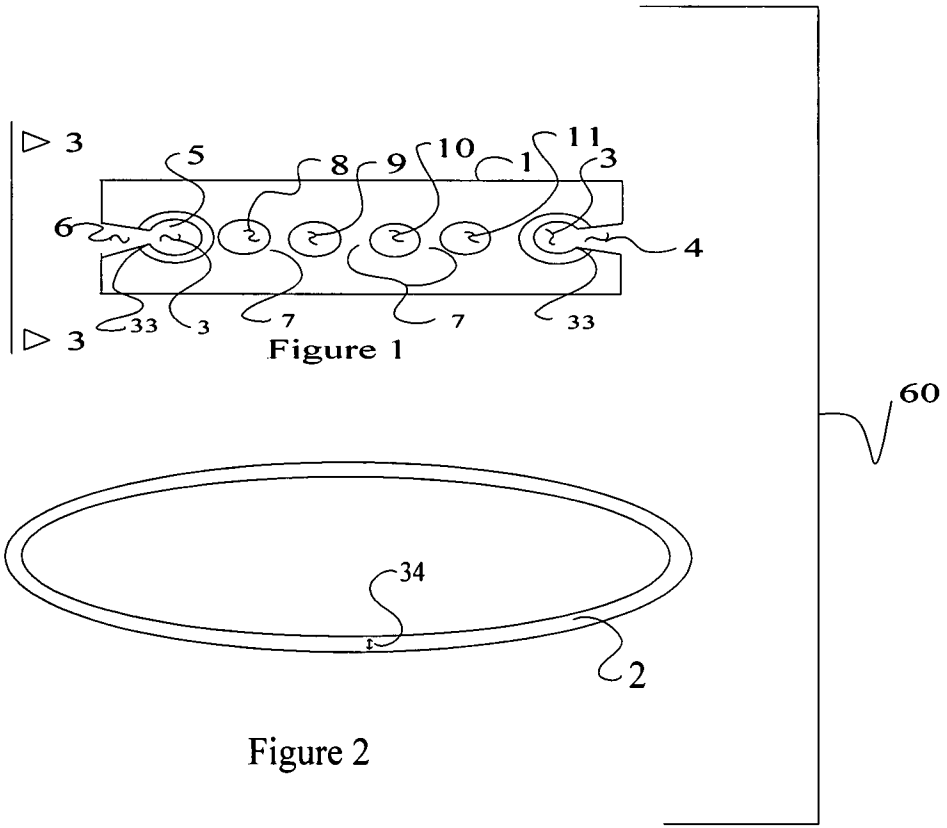
FIG. 1 is a perspective view of the handle front.
FIG. 2 is a perspective view of the string.

FIG. 1 shows a bottom view of the handle body showing that the handle 60 (comprised of the body 1 and string 2) consists of a handle body 1 which is preferably curved (as shown in the side view 3) defining holes 3 and 5 into which a loop string 2 shown on FIG. 2 may be inserted. In order to allow the string to be inserted without being cut, gaps 4 and 6 are defined by the body 1. Preferably the narrowest interior points 33 of the gaps 4 and are smaller than the diameter 34 of the string 2 (shown in FIG. 2) so that the string 2 must be compressed to fit within the openings 3 and 5 which are wider than the interior points 33 so that the string may re-expand and does not easily fall out. The use of gaps 4 and 6 allows for different length strings to be used.

The bottom of the handle defines a slot 14 (Shown in FIG. 4) so that when the hand is holding the handle along the ridges, it faces upward. This slot 14 is stationed upward and away from the pull of gravity, and the end of the string 2 which has been passed through the handles of the bags to be carried can be inserted through the slot 14 in order to half the length of the string so that a single string defines at least two lengths. It may be repeatedly looped through this slot 14 to change the string length.

The gaps 4 and 6 are shown as angled inward so the string may be steadily compressed as the string 2 is inserted into openings 3 and 5. The gaps reopen at the openings 3 and 5 past the narrowest interior points 33 to allow the string 2 to re-expand so it is not easily removed.

Figure 4:
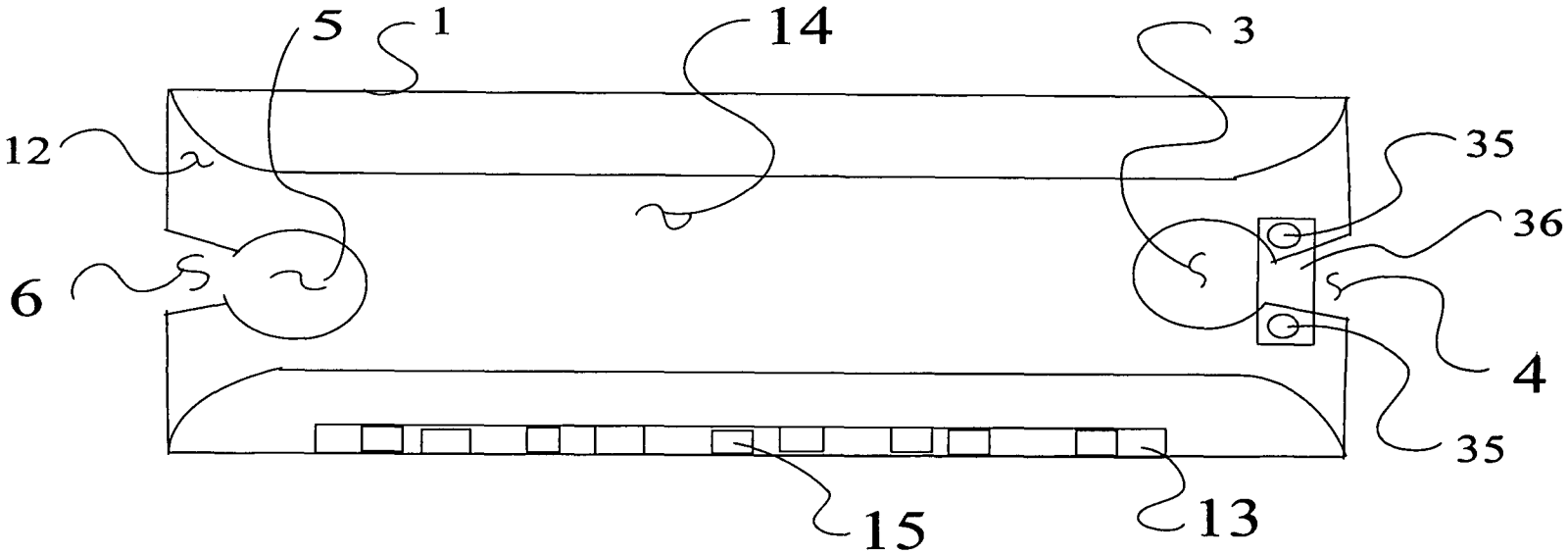
FIG. 4 is perspective view of the handle from FIG. 1 from the rear side.

One alternative is to close the gap (as shown in FIG. 4) after the string is inserted through welding or glue, or with a closing clasp 36.

Figure 3:
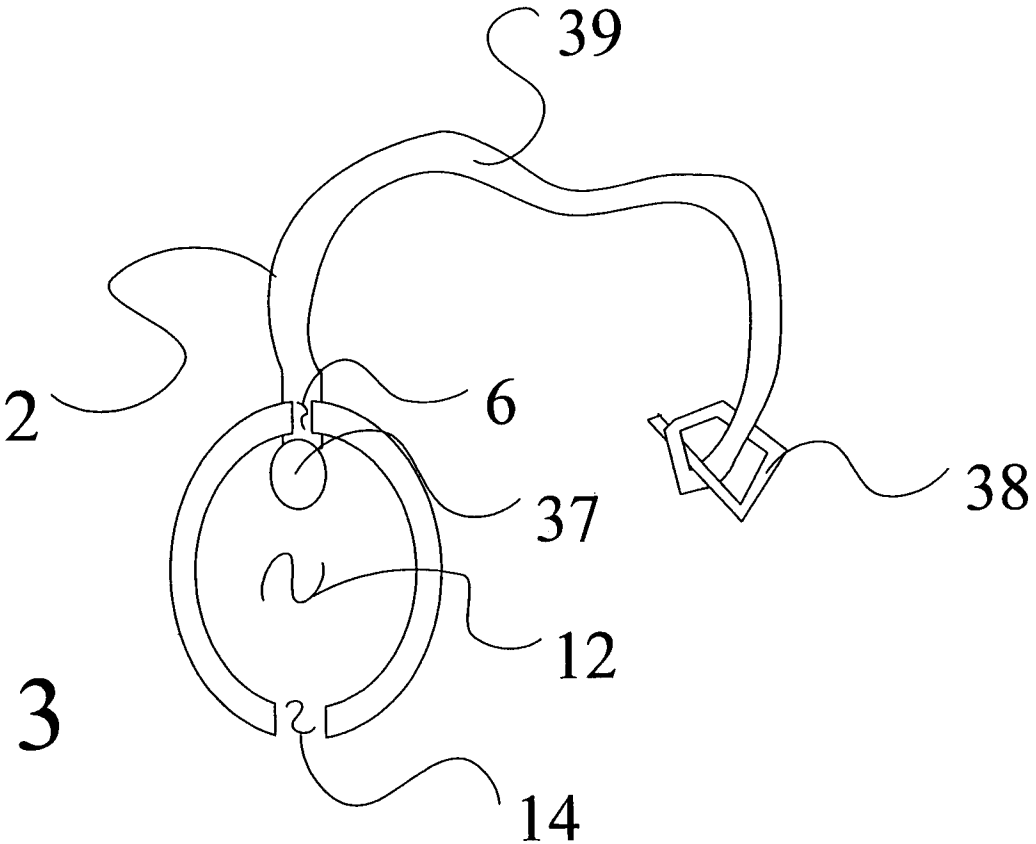
FIG. 3 is an end view from the 3-3 axis shown in FIG. 1.

This closing clasp 36 may arrest the movement of the string 2 to prevent the string from sliding within the body 1, although this is not a requirement. An alternate method shown in FIG. 3 is to secure one end of the string with a button 37 or knot 38. This allows the string to be un-looped with the loop being completed by the handle and prevents sliding of the string 2.

Ridges 7 help the user to hold on to the handle, while indentations 8, 9, 10 and 11 between the ridges 7 serve as places where the fingers of the user (not shown) may go.

Figure 16:
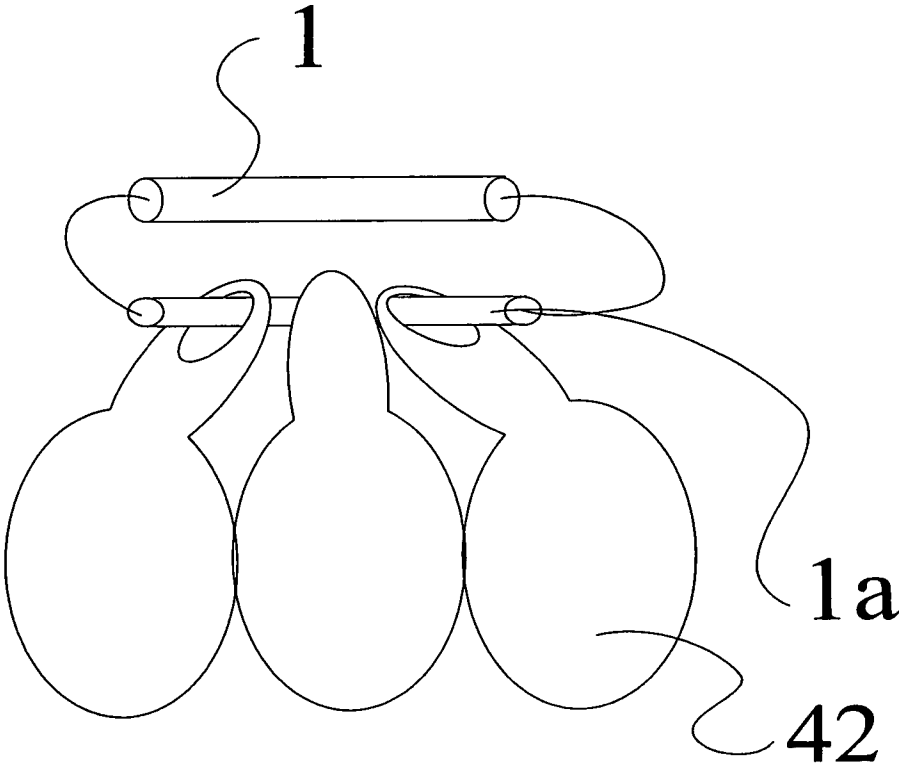
FIG. 16 shows a side view of several bags held by a modified handle.
Figure 17:
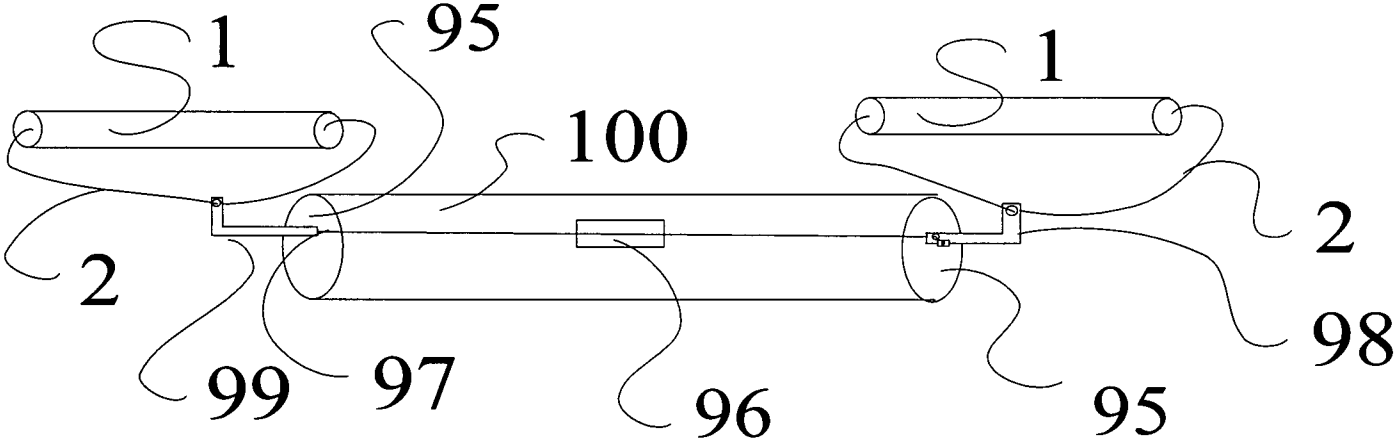
FIG. 17 shows a three part modified handle.

As can best be seen by reference to FIG. 3 the bottom defines a slot 14 whose purpose is to receive the middle 39 of string 2 after it passes around a load (as shown in FIGS. 16 and 17). Slot 14 preferably runs along the entire length of the body 1 opposite the gaps 4 and 6. A central opening 12 runs through the length of the body 1.

FIG. 4 looks through the top of the invention into the central opening 12 through the slot 14 in the body 1. There are raised frictional edges 13 which, in this case, are partially raised letters 15 in order to improve the grip on the side the handle 1.

Figure 5:
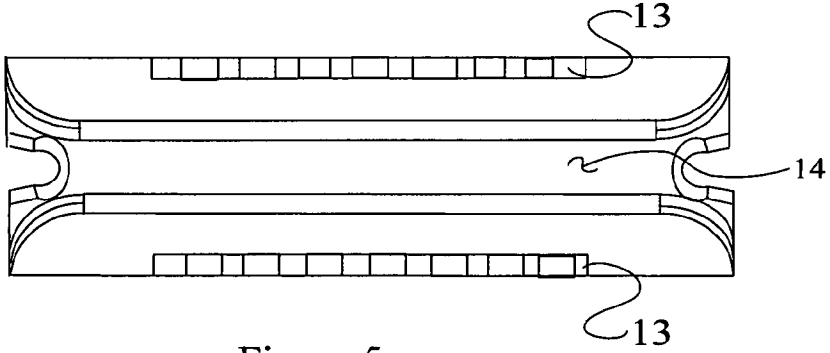
FIG. 5 is a dimensional view of the view shown in FIG. 4.

FIG. 5 is a view of an alternate to FIG. 4 showing raised edges 13 on either side of the slot 14.

Figure 6:
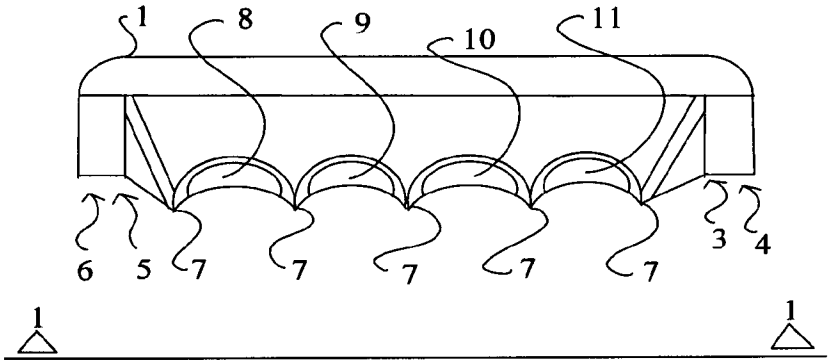
FIG. 6 is a dimensional view of the side of FIG. 5.

FIG. 6 is a perspective view of the side of FIG. 5.

FIG. 6 shows where the holes 3 and 5 and gaps 4 and 6 would be, although they cannot be seen from the side in this view.

Figure 8:
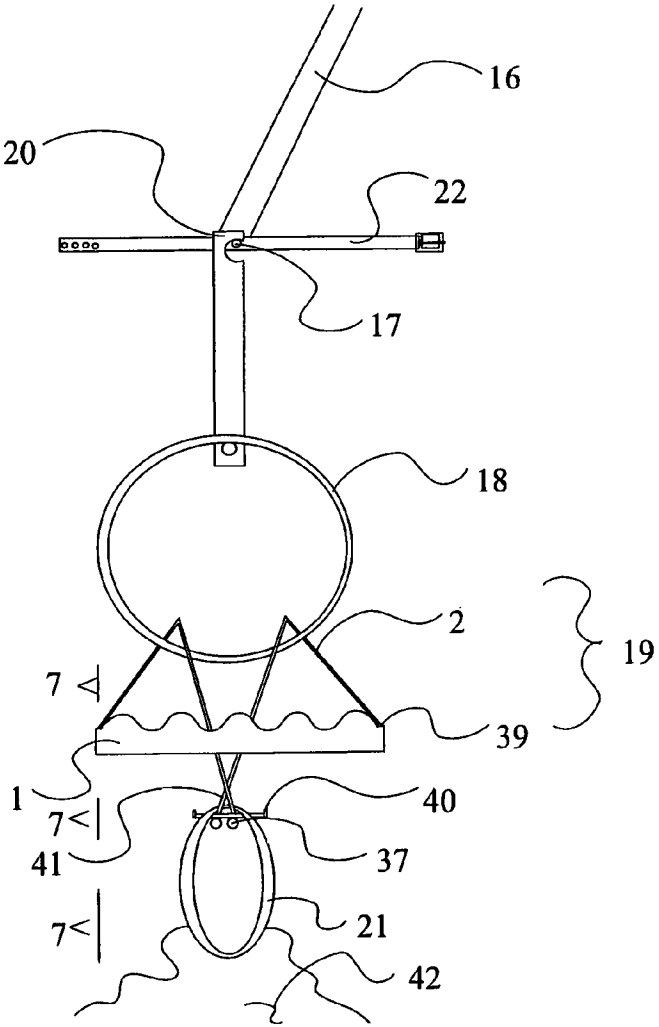
FIG. 8 is a line drawing of a modification of the preferred embodiment.
Figure 7:
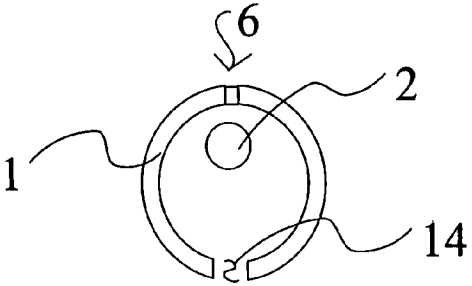
FIG. 7 is a dimensional view of the view shown in FIG. 3.

FIG. 7 is a perspective view of the view of the handle shown in FIG. 8.

FIG. 8 is a view of a modification of the handle. In this modification, a shoulder strap 16 and belt 22, connected to a swivel 17, holds a hook 20 supports a ring 18 through which the handle 1 and string 2 are looped to hold one or more handles 21 of a bag 42 with a loop 19 in the string 2. Here, the handles 21 are held by a bar 40 which receives the ends 41 of the string 2 with buttons 37 in this alternate view.

The attachment means in FIG. 8 may be moved to the side of the user.

Figure 9:
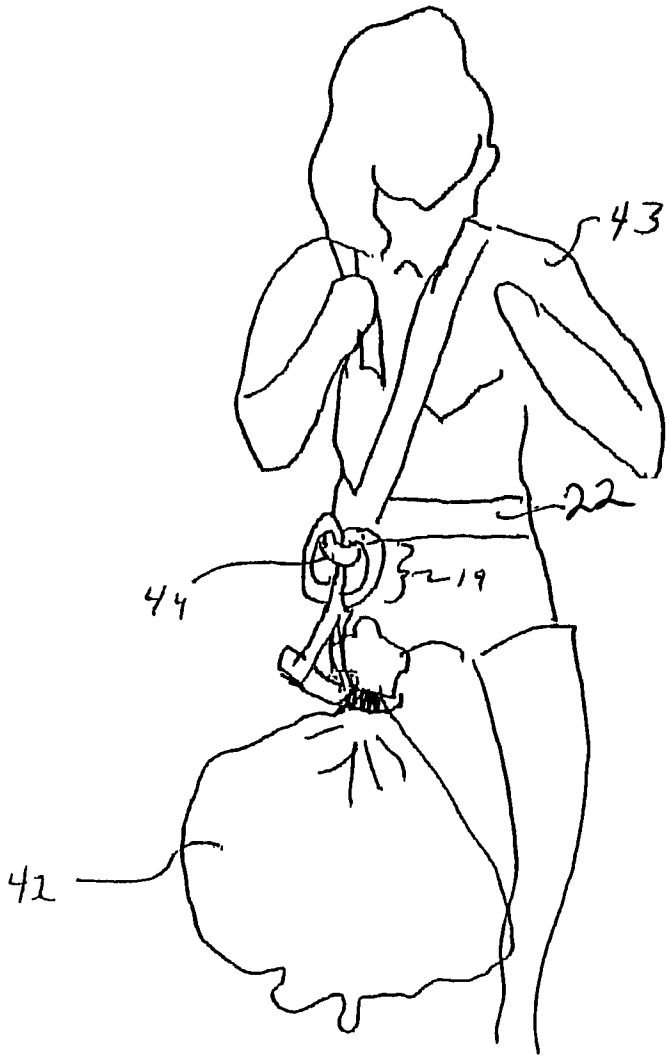
FIG. 9 is a larger view of FIG. 8

FIG. 9 is a view of an alternate embodiment to FIG. 8 showing where the belt 22 has been connected to the strap 16 to provide more support to the user 43. Here, the loop 19 is formed with the middle 39 of the string 2 through a loop 44 in the belt 22.

Figure 10:
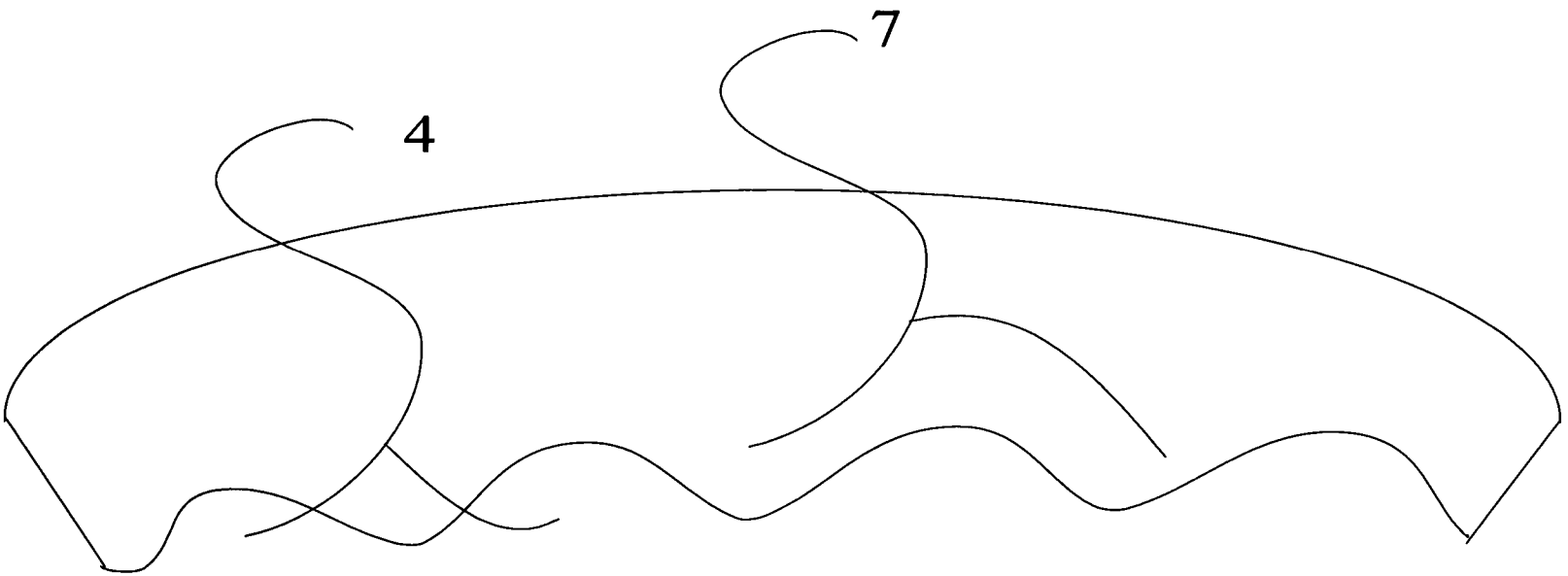
FIG. 10 is a side view of an alternate embodiment of FIG. 1.

FIG. 10 is a side view of an alternate embodiment of FIG. 1 where the handle is curved to make it easier to hold.

Figure 11:
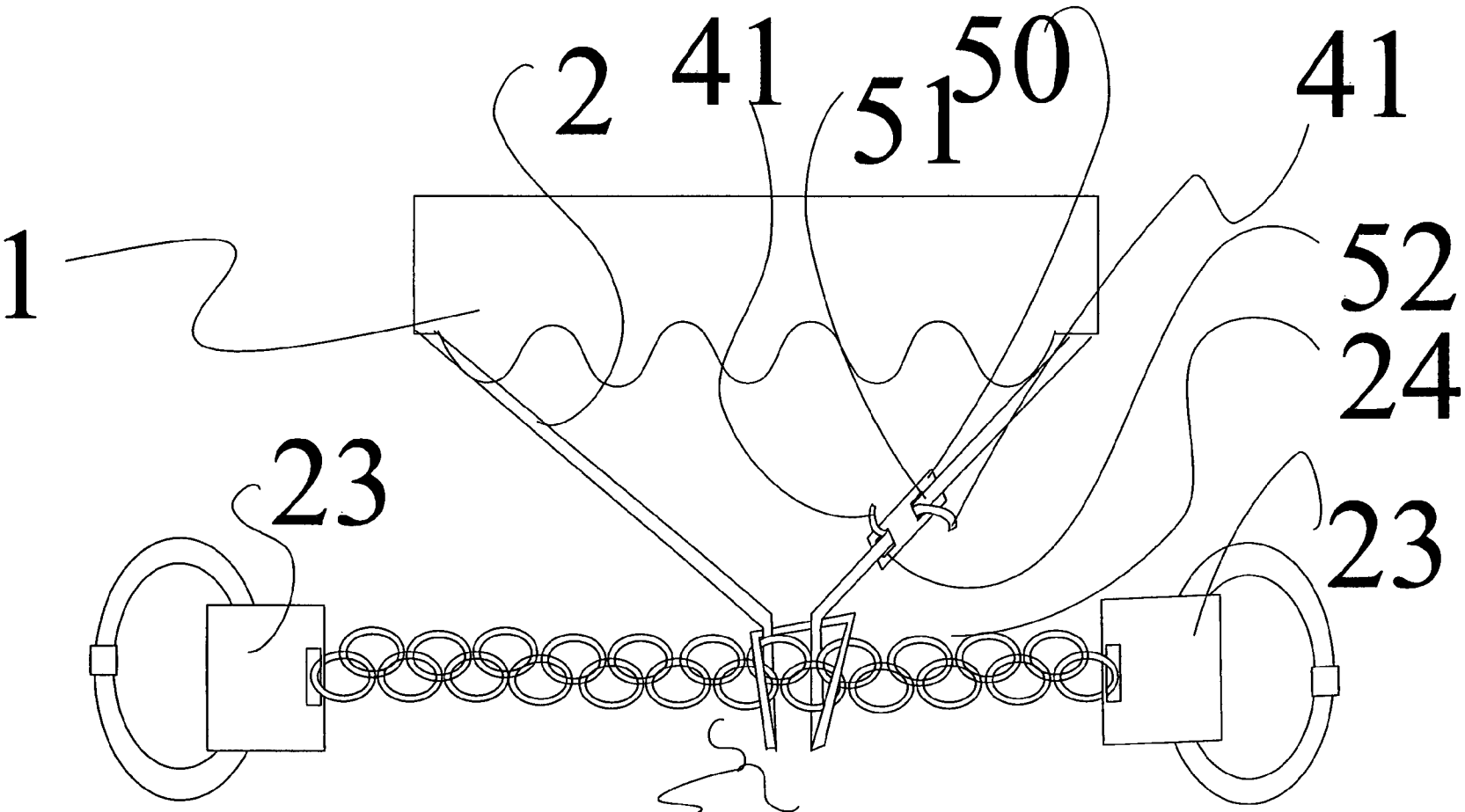
FIG. 11 shows an alternate embodiment of the invention.

FIG. 11 shows an alternate embodiment of the invention whereby handcuffs 23 are held by a loop 19 around the chain 24 of the cuffs 23. This handle body 1 may be solid with the string 2 permanently attached to prevent the detainee wearing the cuffs from slipping away from the handle 1. The handle 1 may be held or shut into a door to secure the position of the cuffs 23. The string may, where desirable, be replaced with wire or insulated wire.

While the string 2 is described in a preferred embodiment, it is obvious that heavier rope might be used for some industrial purposes. Strings 2 may be replaced with straps 70. Straps 70 or strings 2 with buckles 50 receiving the strap through holes 51 and 52 allow the user to vary the length of the string.

Figure 12:
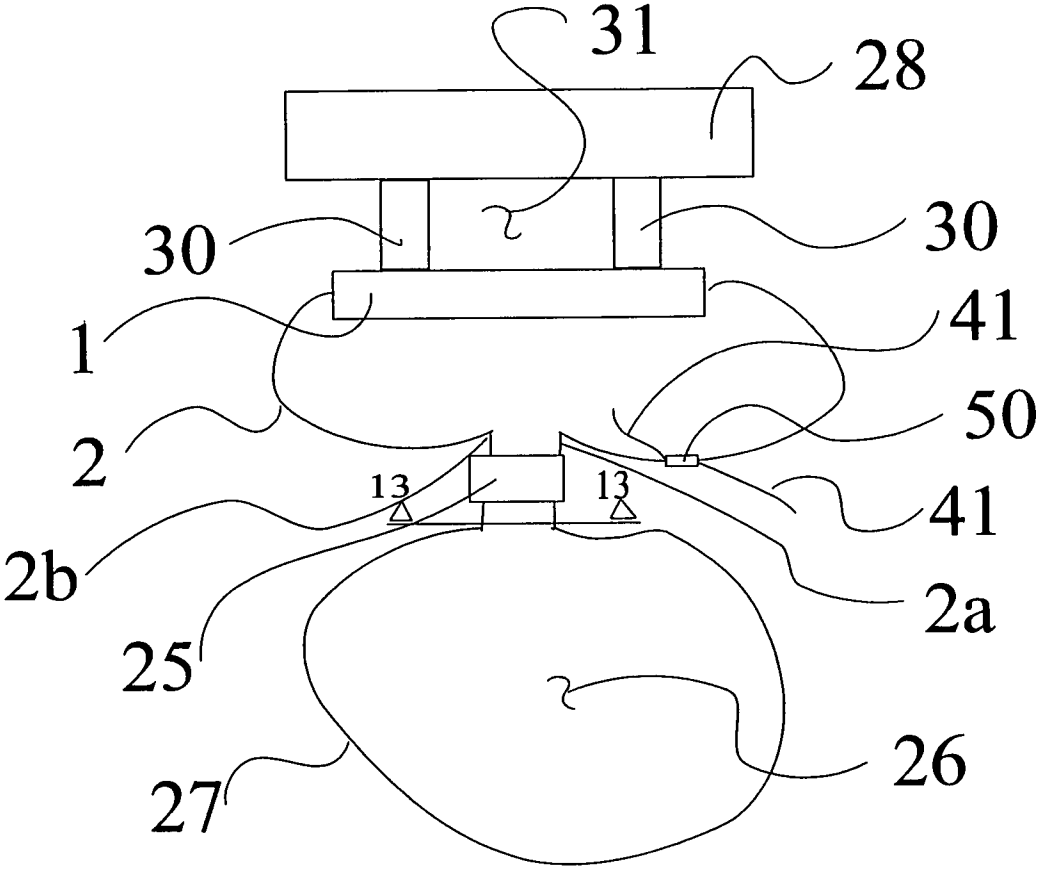
FIG. 12 is a view of a second alternative embodiment.

FIG. 12 is a view of an alternate embodiment. This figure shows how a clasp 25 may define an opening 26 (shown in FIG. 13) as it slides along the string 2 to secure a load 32 (shown in FIG. 14) held in the hoop 27 with an adjustable interior (opening 26) defined by the string 2 when a larger load (such as logs as shown in FIG. 14) is being carried. This embodiment also shows a hand guard 28 held by two posts 30. Between the posts 30 is a gap 31 into which the users hand is inserted. In this way, a large load 32 is separated from the hand of the user holding the guard 28.

Figure 13:
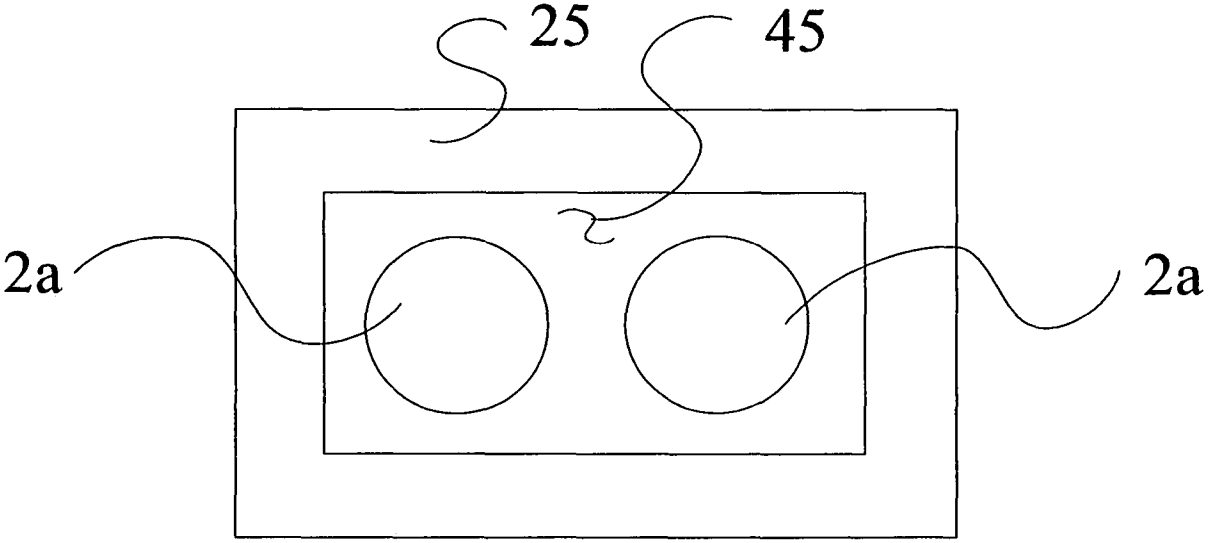
FIG. 13 is a detailed view of the buckle from FIG. 12 through the 13-13 axis.
Figure 14:
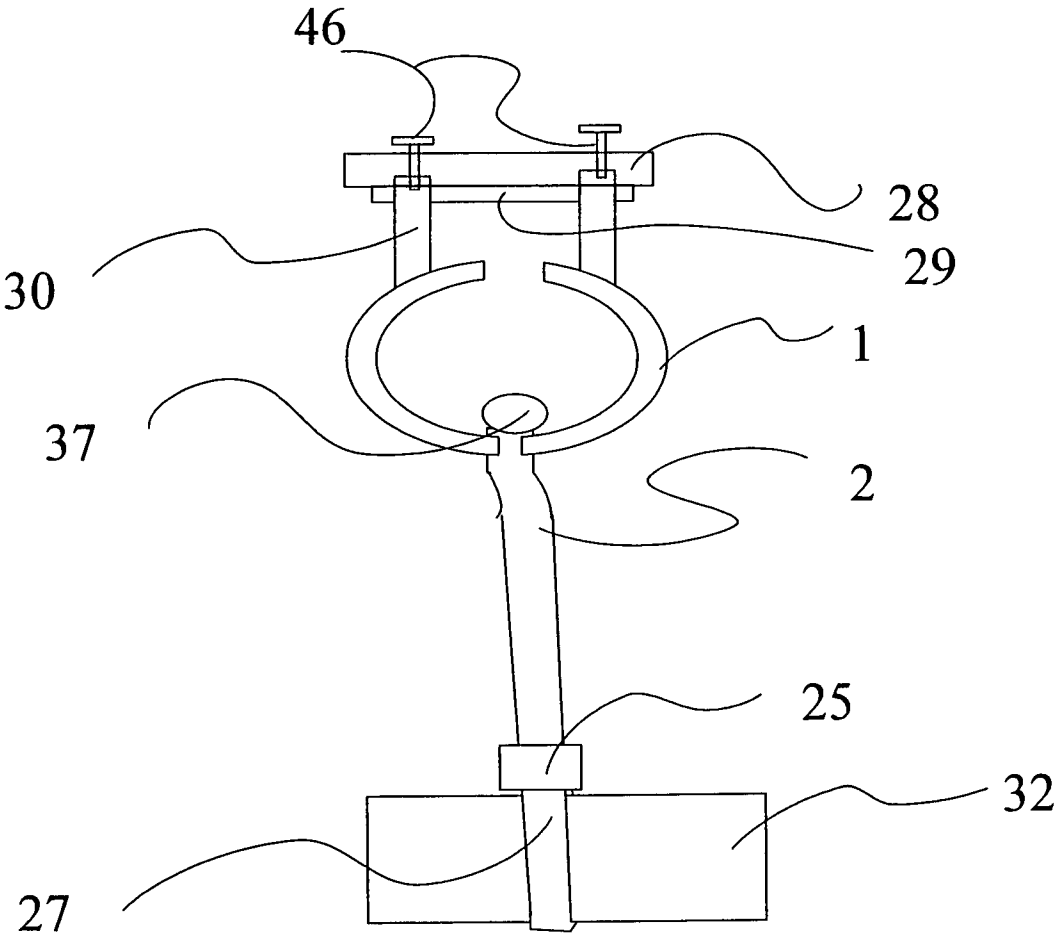
FIG. 14 is a side view of FIG. 12.

FIG. 13 is a detail view from FIG. 12 through the 13-13 axis. The interior space of the clasp 25 is preferably approximately the same width as the two sides 2*a* and 2*b* of string 2.

FIG. 14 is a side view of FIG. 12 which shows how a pad 29 may be placed on the hand guard 28. Screws 46 hold the hand guard 28 to the posts 30 which here are a permanent part of the body 1 in this embodiment.

Figure 15:
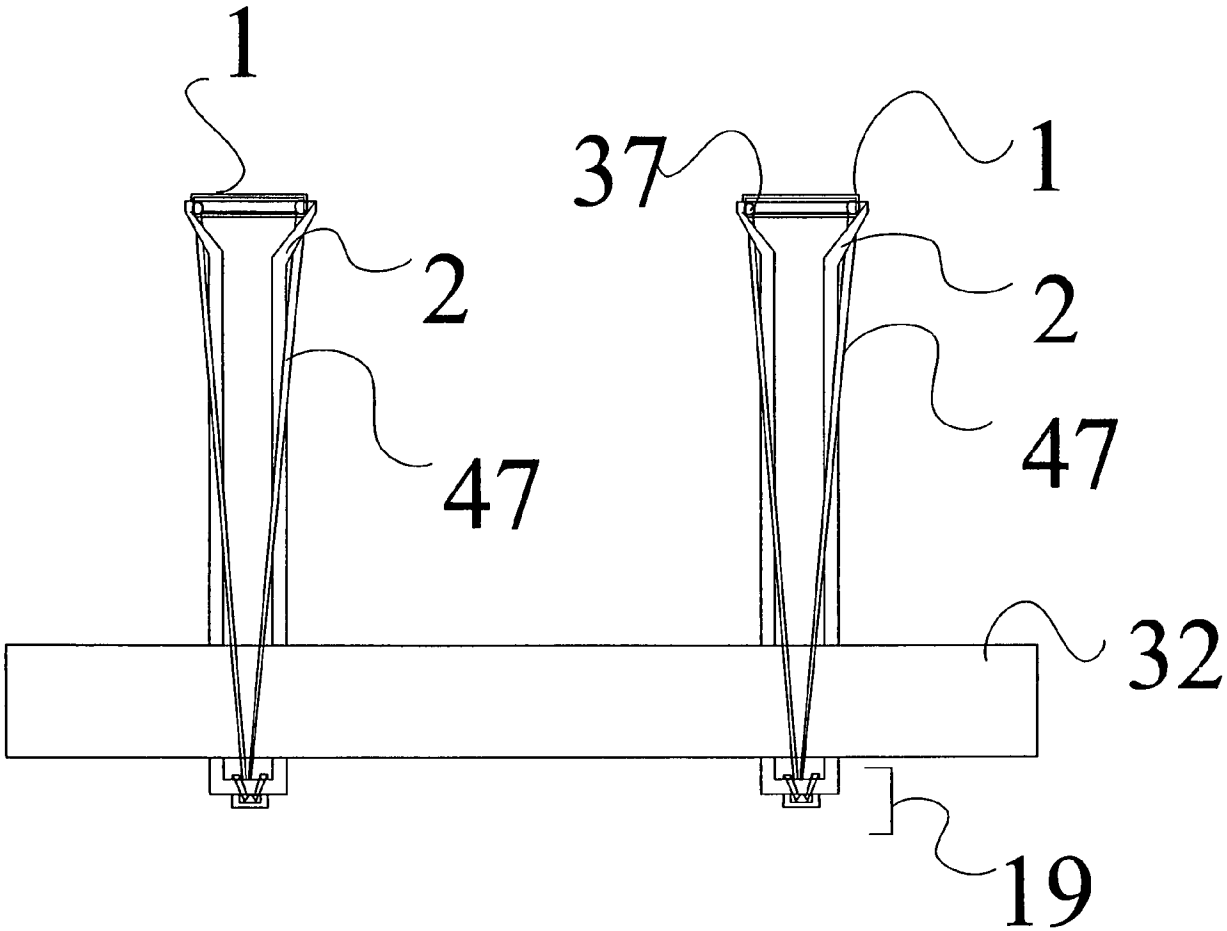
FIG. 15 shows a view of a large load being held.

FIG. 15 shows a view of a large load 32 held by the invention using a longer loop here made of two loops first loop 2 and second loop 47 joined at the connecting loop 19 (one string around the other) which goes from the handle 1, around a large load 32 at the loop 19 and back to the handle 1 where the second string 47 fits within the slot 14 with the handle 1 (not shown in this view).

FIG. 16 shows a side view of several bags 42 held by a modified handle. This handle has a top handle 1 and a bottom handle 1*a* to lower the height at which the bags 42 are held.

FIG. 17 shows a three part modified handle. To carry the large load 32, a left elbow and right elbow 99 respectively, are attached by a line 97 tightened by a buckle 96 to allow the elbows 99 and 98 to be kept at an even spacing and tightly held to the sides 95 of the load 100. Each elbow is attached to a handle body 1 by a string 2.

Figure 18:
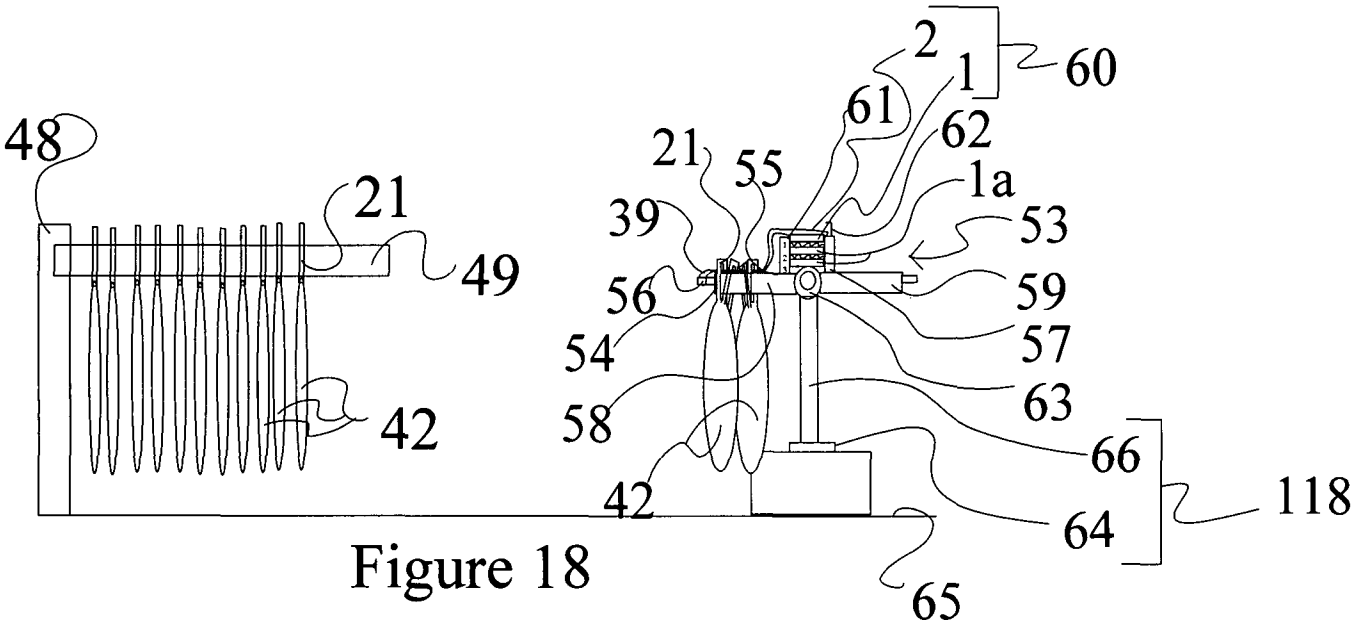
FIG. 18 shows an alternate embodiment where the invention is used in conjunction with the bags.

FIG. 18 shows an embodiment showing the primary invention where handles are used in conjunction with the bags 42, preferably plastic bags, coming off of the first rack 48 having an arm 49. The first rack 48 is a prior art type of rack which provides for the loading of one plastic bag at a time. The bag is removed by both bag handles 21, grasped separately. This bagging system is used within the present invention.

The length of the arms 58 and 59 and strings 2 are preferably within a ½" size of one another. The arms 58 and 59 should have a length of approximately 12" (at least 8" but no more than 36").

In the embodiment of the invention shown in FIG. 18, there is a second rack 53 which comprises a first rack arm 58. Arm 58 has a first front end 54 and a first rear end 55. The first front end 54 has an extending catch 56 for receiving the middle 39 of the loop of string 2. The rear end 55 comprises a support 57 for receiving at least one and preferably a plurality of handles 60 so that sequentially the arms 58 and 59 are supported above the surface 65 by a post 66 and each successive handle 60 may be accessed and each successive string 2 may be pulled out and placed on the extending catch 56 over the rack arms 58 and 59 sequentially.

These bags are removed from the first rack 48 and they are inserted over the first front end 54 and towards the rear 55 over string 2 until the entire rack arm 58 is fully loaded with bags 42. Thereafter, the handle body 1 may be brought forward pulling the bag handles 21 together and the handle body 1 is inserted through the middle 39 of the loop formed by the string simultaneously removing the string middle 39 from the catch 56 and pulled tight in order to close the bags 42 and allow them to be lifted together off of the rack arm 58.

In the preferred embodiment after the arm 58 is loaded, the post 66 may be rotated around a bearing 64 so that the second arm 59 of identical design is rotated in place and may be loaded with a second plurality of bags while the handle 60 is removed from the first rack arm 58. This allows for the arms 58 and 59 to be continuously and sequentially loaded and unloaded about a spindle 118 comprised of bearing 64 and post 66.

In order to provide for a plurality of handles 60 and strings 2 they may be loaded underneath each other with the string 2 of the following handle up. The middle handle carrying support 57 is filled with three handles 60 each having a string. The support 57 may have the handles 60 sequentially numbered with numbers 61, so that the handles 60 may be counted as they are removed. They may be removed over a counter bar 62 triggering a counter (not shown) in order to allow the number of handles used to be counted for billing purposes.

In order to allow the system to be efficiently used, the counter 62 is provided so the counter 62 may be raised like a mail box flag in order to indicate that the loader is to be utilized for the bags.

The arms 58 and 59 may be folded upward or downward at hinges 63 at the back of these loading arms in order to have them out of the way unless they are in use.

Handle 1*a* with string 2*a* below handle 1 form second strap means which may be sequentially dispensed. Handle 1*b* with string 2*b* is a third sequentially dispensed handle.

Figure 19:
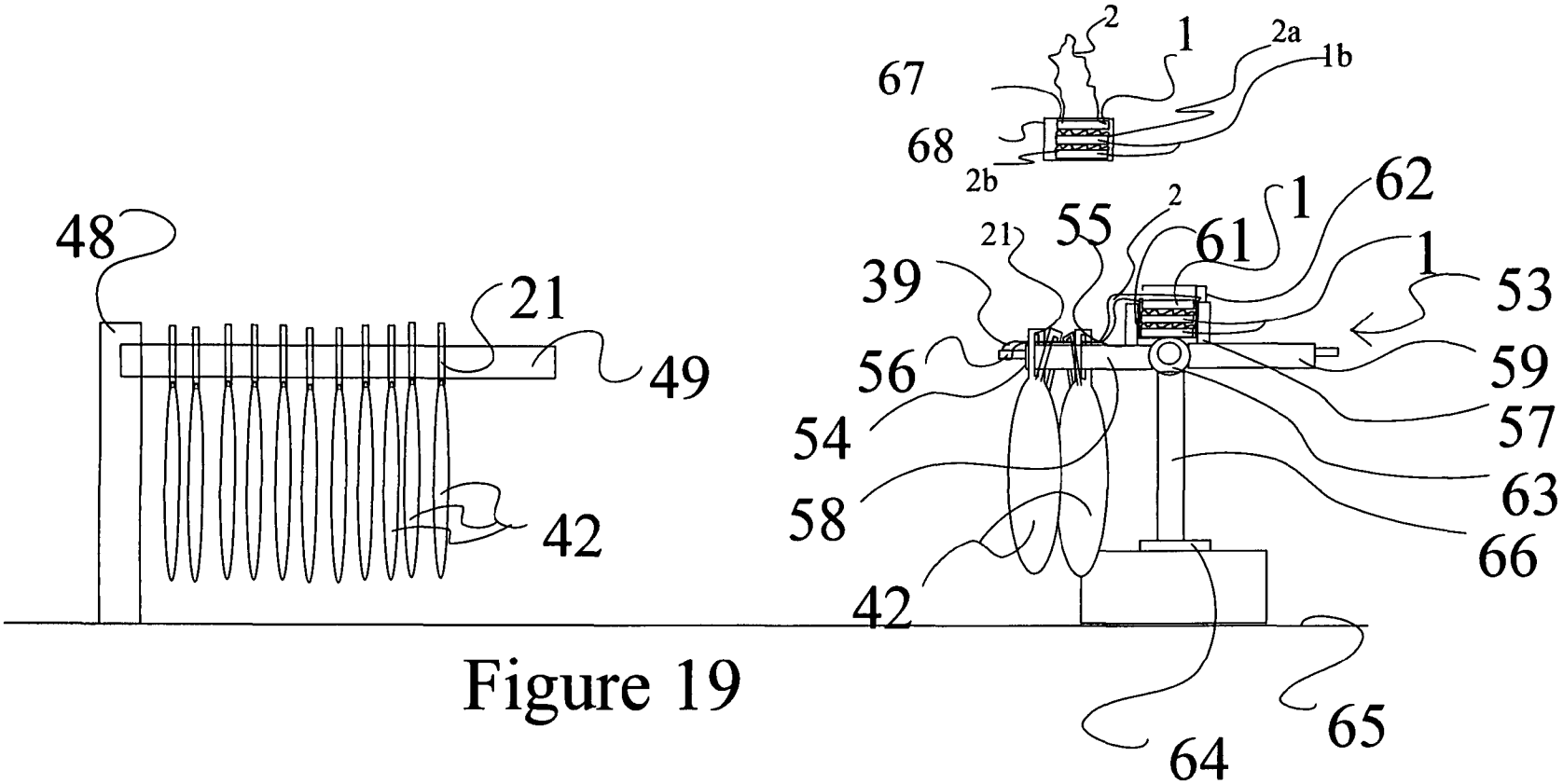
FIG. 19 shows a box holder with the embodiment of FIG. 18.
Figure 20:
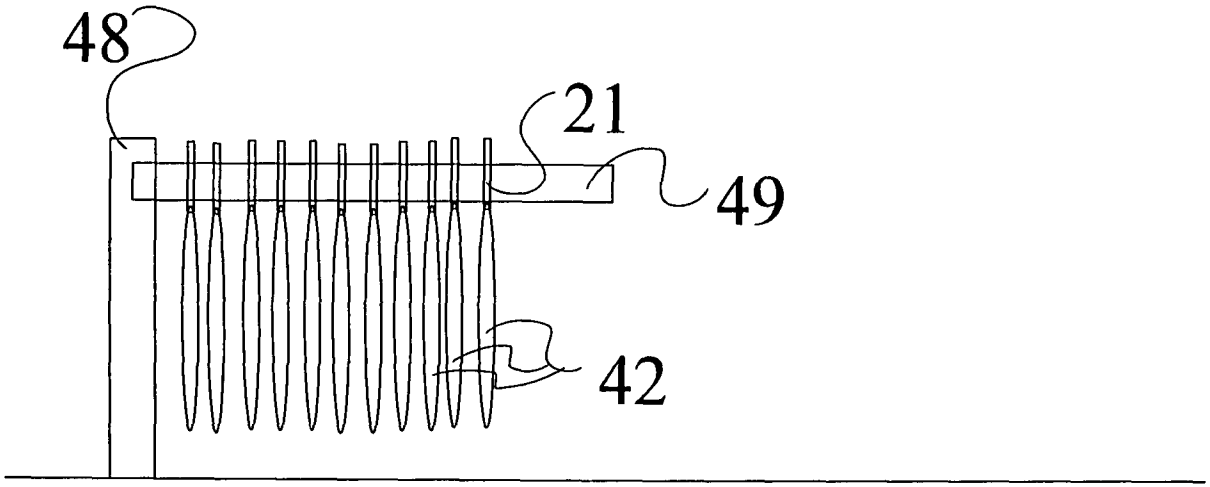
FIG. 20 shows the portion of FIGS. 18 and 19 (which is prior art) and which are bag holders which allow sequential bags to be loaded with groceries before the loaded bags are loaded onto the new portion of the invention.

FIG. 19 shows a box 68 in the embodiment shown in FIG. 20 which box 68 has a lid 67. The support 57 receives the box as shown in FIG. 19 and the lid 67 is opened. Before the user is checked out, the box 68 is sold and any left over handles are put with the box 68 into the last plastic bag with the user's order.

FIG. 20 shows a bag loader.

Figure 21:
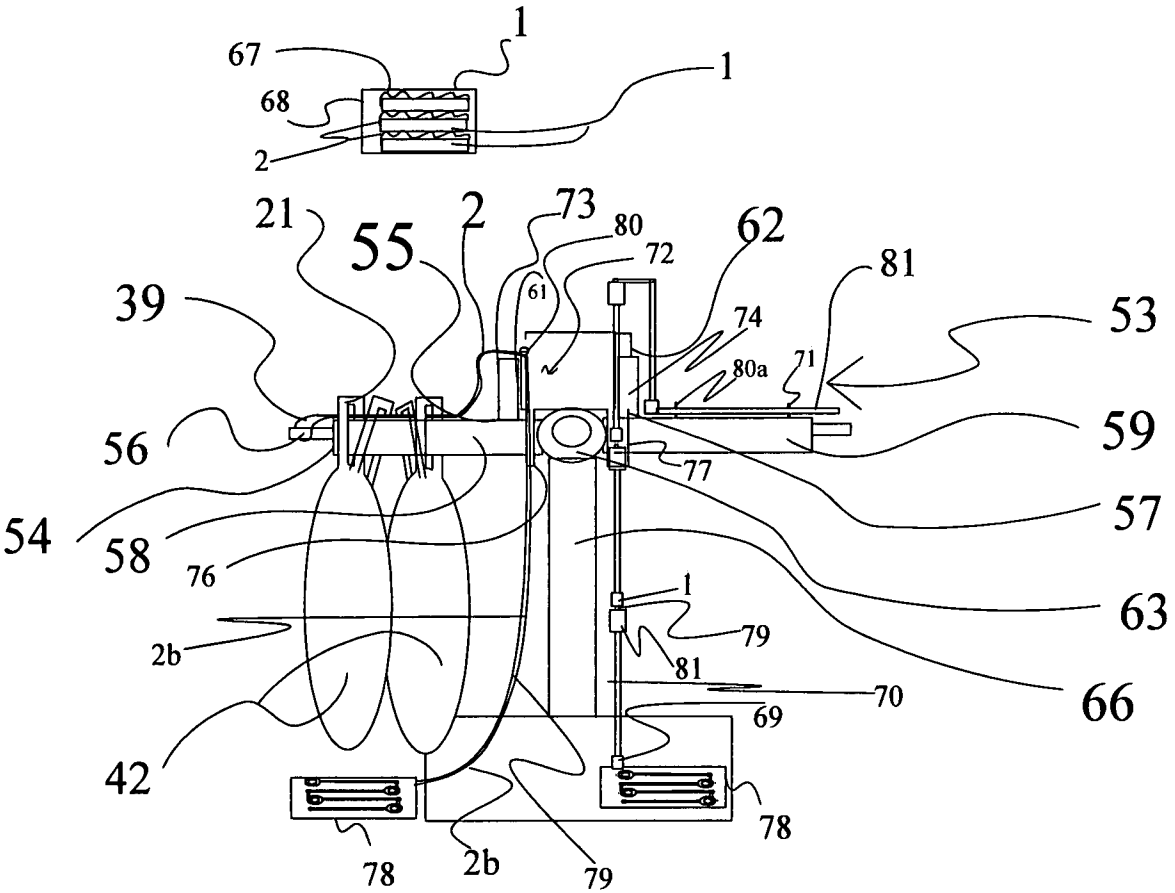
FIG. 21 shows the preferred embodiment of the invention.

FIG. 21 shows the preferred embodiment of the invention.

This embodiment shows multiple loops 2 in series coming out of a box 78. These loops 2 are connected by connectors 79 at which the loops can be separated so that they may be sequentially used in the fashion shown.

In this embodiment the connectors 79 hook on to latch 80 which holds one end of the loop while the other end of the loop, which is the middle of the loop 39, goes around extending catch 56 to hold it in place so that latch 80 defines a holding means attached to the first front end for holding the strap first end.

In this way, once the bag 42 are in place over the rack arm 58 so that the handles 21 are over the loop 2, the end of the loop held by latch 80 may be disconnected by the following loop identified as 2*a* which is followed by another loop 2*b* and subsequent loops, not shown, but coming out of box 78. One end of the loop may be inserted by through the other end of the loop in order to secure the bags 42 which may be then lifted away, securing bag handles 21 together from the rack arm 58.

In this embodiment a handle body 1 may be used in order to hold the loop in the manner taught in the other drawings.

In this embodiment, one alternative is to allow for a box of at least two handles. One with loops 2 and a handle dispensing box 68 to be put in place in the box holding opening 72 which box holding opening 72 is designed to grab tightly the box 68 which preferably has a tear away lid 67.

The benefit of this is more expensive handles can be purchased for users who do not want to hold the strings themselves and the dispenser can be made to dispense these or the handles may be used subsequent to dispensing by selling them without the strings 2 attached.

The loops can then be secured into the handle 1 by inserting into openings 3 and 5 ends of the loop so that a portion of the loop is held within central opening 12. This allows users to buy handles if they like or buy handles and merely use loops 2 in order to tie the bags together using a loading arm 58 and securing the rope on either end using catch 56 at one end and latch 80 at the other end.

In this embodiment, there is a tubular opening defined in the bottom of the rack arm 58 and within the left wall 73 and right wall 74 of the box holding opening 72 so that the loops 2 may come up through the same space or adjacent to the space holding the box 68.

An identical arrangement is present on the opposite side so that you have a left opening 76 and a right opening 77.

Figure 22:
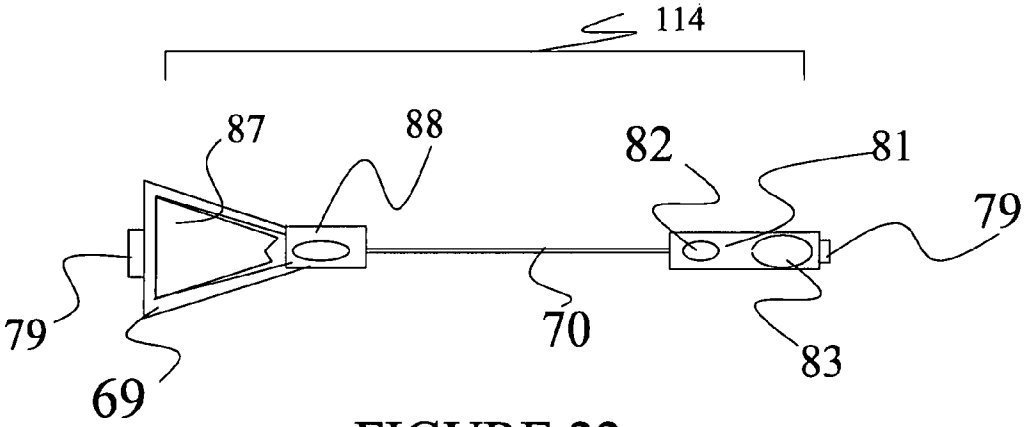
FIG. 22 shows the preferred embodiment of a strap in place of a handle and rope.

In this case, the invention is shown with an alternate embodiment at the right opening 77 where the loops 2 are replaced with continuous stamped plastic handles 114 comprised of a band 70 with a handle 69 on one end and a loop frame 81 on the other end. The loop frame 81 defines a vertical catch hole 82 to be received on vertical catch 71 on the end of arm 59 and a handle receiving hole 83 to receive the handle 69 as shown in FIG. 22 so that catch 71 defines a second holding means attached to the first rear end for holding the strap second end.

The loop frame 81 of one stamped plastic handle 114 is attached sequentially to the handle 69 of a following stamped plastic handle 114 by connectors 79. The connector 79 may be broken by pulling or may be cut to separate handles from connectors 79.

The description of the string 2 and the band 70 in FIG. 21 should be differentiated from anything in the prior art by noticing that they are continuous with each sequential loop 2 or band 70 as is shown in FIG. 21 and in some of the subsequent figures.

While strings 2 are shown on one arm 58 and band 70 on the other arm, it is clear that strings 2 or bands 70 could be used on both arms.

FIG. 22 shows the preferred embodiment of the stamped plastic handle 114 which shows a connector remnant 79 on the front and the back where the preceding handle 69 and following loop frame 81 would be attached before separation. In this piece, the device has a handle 69 on one end and attached to the handle is a wrap 87 which is the material from the wrap space 85 shown in FIG. 23.

Figure 23:
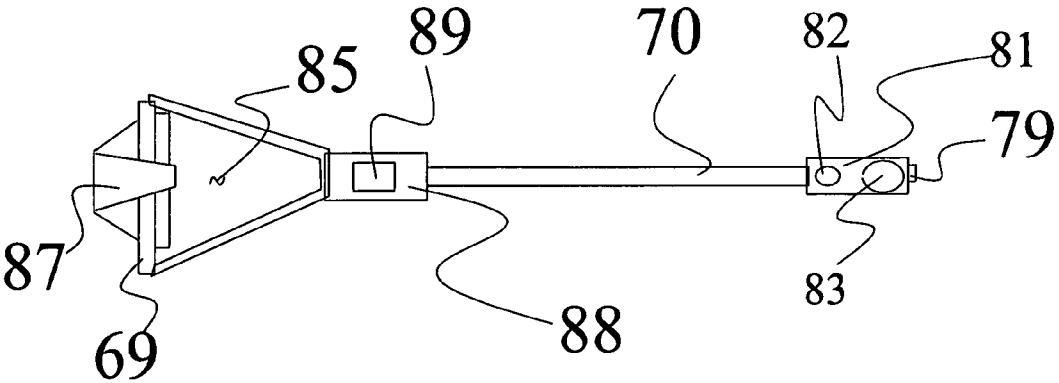
FIG. 23 shows a view of a slightly altered embodiment of the strap from FIG. 22.

As can be seen by reference to FIG. 23 the wrap 87 can wrap around the handle 69 in order to cushion the handle 69 further and to leave a wrap space 85 where the users' hand will go when the bag is lifted. The device also includes a handle frame 88 which defines a latch hole 89 which can hook on to the latch 80 (as shown in FIG. 21) to hold the device in place on the handle end on the end nearest the handle 69.

There is a band 70 which has a length over which the bag handles 21 lay as the device is loaded over the rack arm 58 as shown in FIG. 21.

In order to hold the stamped plastic handle 114 in place while the bags are loaded, there is a vertical catch hole 82 which holds the vertical catch 71 to hold it in place. Once the handle 69 is separated from the latch 80 it can be inserted into the handle receiving hole 83 which is within the loop frame 81 in front of the vertical catch hole 82 so that while the bags 42 are being held on the band 70 which in turn rests on the rack arm 58, the string 2 can be completed before removing the bags 42.

Figure 24:
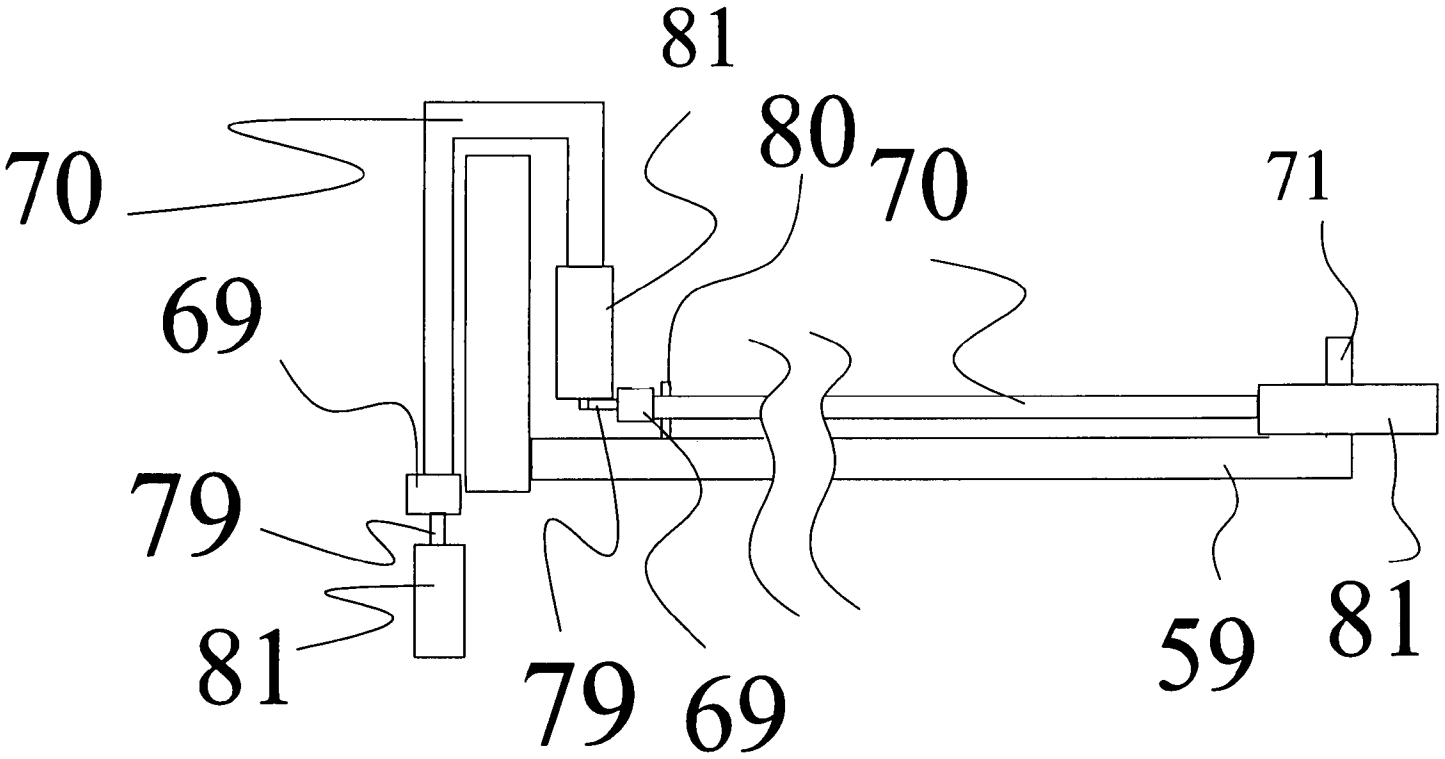
FIG. 24 shows a detail side view of the embodiment in FIG. 21.

FIG. 24 shows a close up detail side view of the embodiment shown in FIG. 21 showing the loop frame 81 in place with the vertical catch hole 82 over the vertical catch 71. Because it is a side view, the vertical catch hole 82 which is over latch 80 cannot be seen in this view. The sequential loop frames 81, bands 70 and handles 69, can be seen connected by successive connectors 79.

Figure 25:
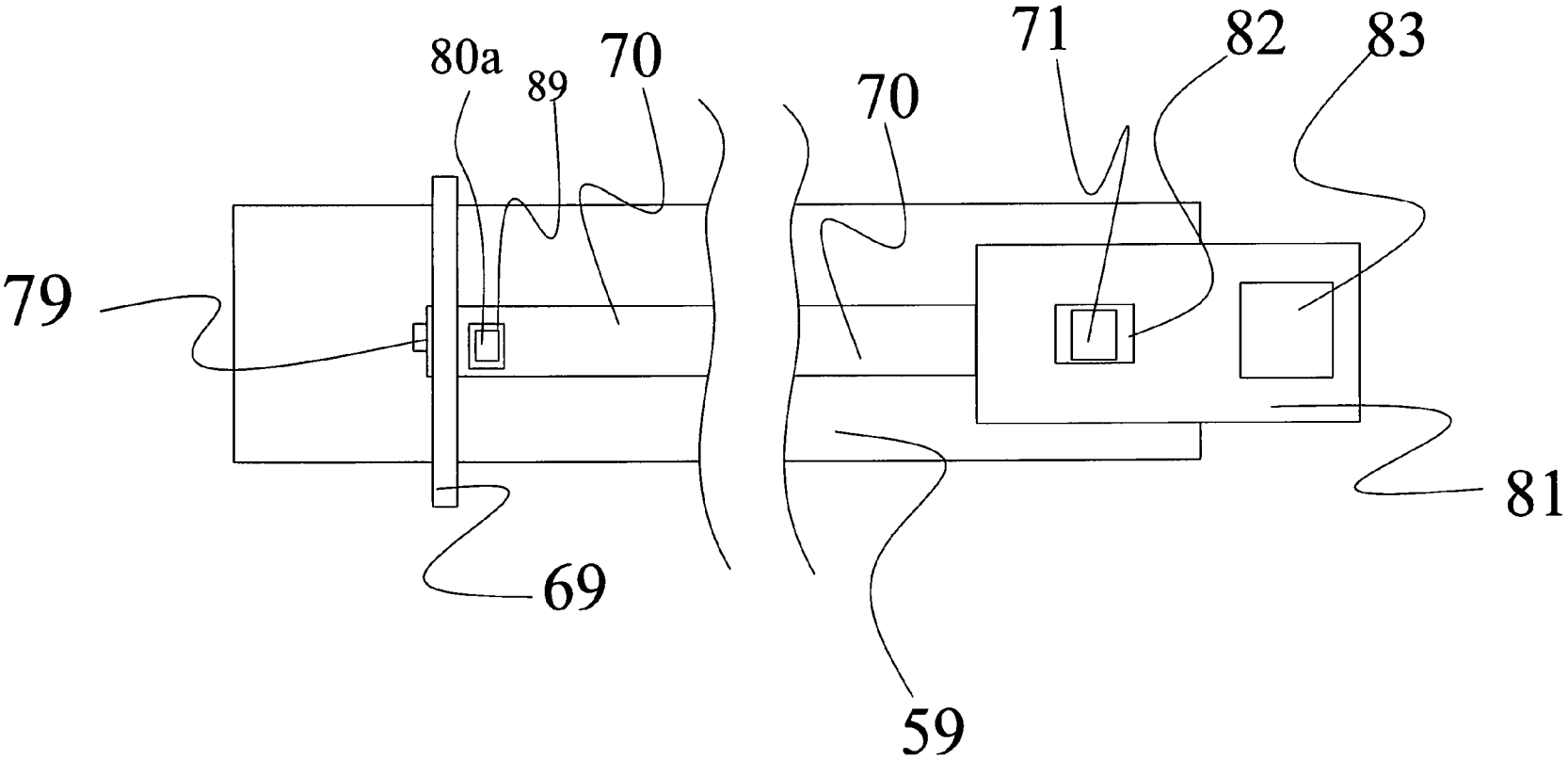
FIG. 25 shows a detail top view of the embodiment of FIG. 24.

FIG. 25 shows a top view of the embodiment shown in FIG. 24 so that all of the parts can be seen with the difference being that in FIG. 24, the following loop frame 81 is shown connected by connectors 79. In order to have the picture more clearly shown, it is not shown in FIG. 25, although the connector 79 where it would be connected is shown.

It is noted that while rack arm 58 and second rack arm 59 are shown as having slightly different designs, the purpose is to show how the product can be designed flexibly and not that you could not have identical designs on either rack arm. It is possible to eliminate the first rack arm 58 or the second rack arm 59 without deviating from the design, just as it would be as easy to add a third rack arm without deviating from the inventive concept shown herein, or even to add a fourth or fifth arm.

It is obvious that a number of arms is variable within the users discretion as long as one arm does not interfere with the operation of another arm as the number may be reduced from several to one.

Another difference shown in the embodiment in FIGS. 24 and 25 is that the embodiment shown in FIGS. 22 and 23, the latch hole 89 is built directly into the end of the band 70 closest to the handle 69 as opposed to having a separate handle frame and the exact design is discretionary to the user as long as the function remains the same.

Figure 26:
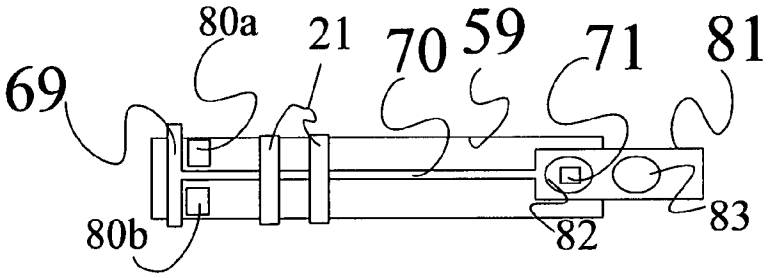
FIG. 26 shows a slightly modified version of the version shown in FIG. 25.

FIG. 26 shows a slightly modified version of the version shown in FIG. 25 and two bag handles 21 are in place over the band 70 and rack arm 59.

While the shape of the openings 82 and 83 is shown to be different in this figure, it is just to allow the user to see that the shape may be modified according to the needs of the user. Also, in this case, the latch hole 89 is replaced with two latches 80*a* and 80*b* as opposed to one latch 80. Latches 80*a* and 80*b* are on either side of the strap 70 closest to the handle 69 to hold the handle 69 in place.

Figure 27:
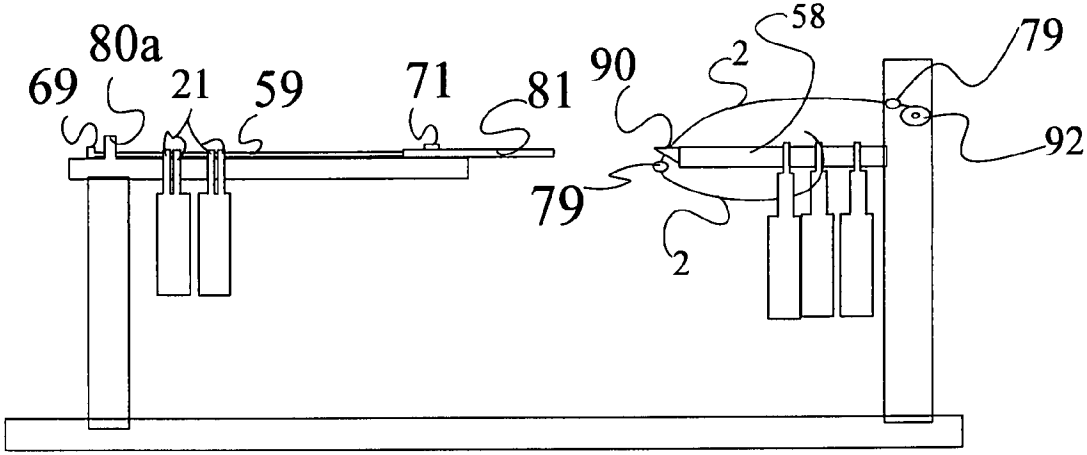
FIG. 27 shows two alternatives of the embodiment of FIG. 26 one having a cutting device to cut the connectors.

FIG. 27 shows a side view of the embodiment shown in FIG. 26 on one side. On the opposite side of FIG. 27 is shown a series of strings 2 which can attach underneath the bag holders and can be cut with a cutter 90 which is mounted on the end of a rack arm 58 for this purpose. This is to show a more complicated alternative version of the invention juxtaposed with the preferred embodiment and to show a cutter 90 which can be located to cut the connectors 79.

It is noted that the use of two latches 80*a* and 80*b* can be mimicked on the other end of strap 70 by having two vertical catches 71 on either side of the band 70 closest to the loop frame 81.

On the right side of FIG. 27, it is noted that the connector 79 between the two loop sections is the point at which the two loops would be cut from one another to prevent a loop from being damaged.

Figure 28:
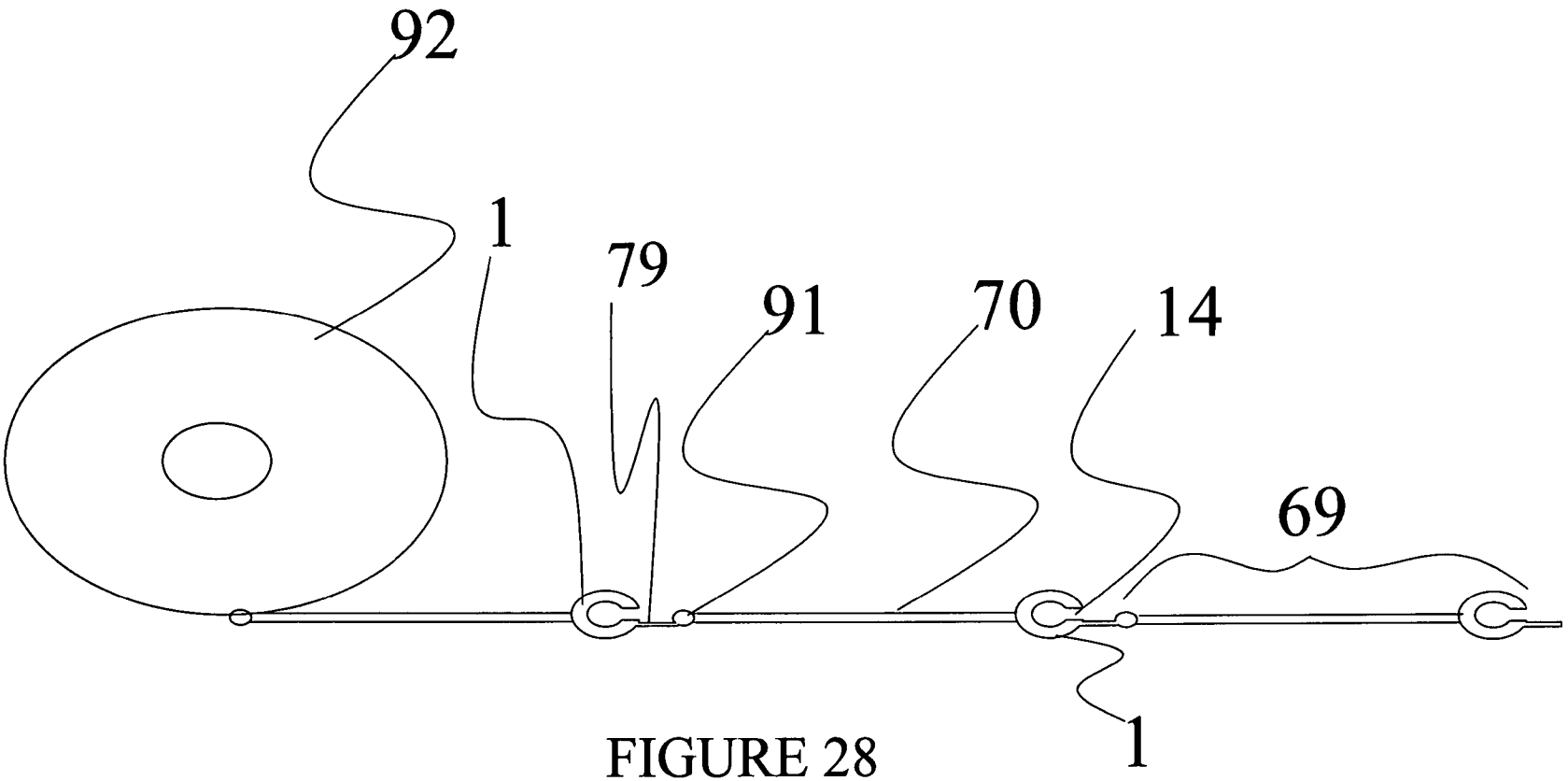
FIG. 28 shows an alternate version of a continuous series of straps designed to replace a handle and rope as shown in FIG. 1.
Figure 29:
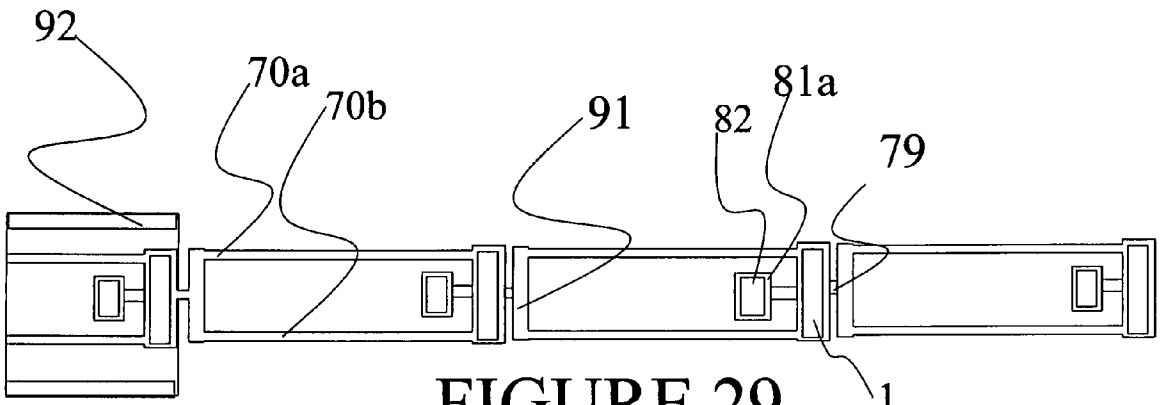
FIG. 29 shows is a top view of the embodiment of FIG. 28.

FIG. 28 shows an alternate version of a continuous series of straps where each of the straps in this case is designed to receive a handle like the embodiment shown in FIG. 1 with the difference being that each handle 1 is connected by a connector 79 to the end of a plastic loop which can be described as a handle catch 91 (see FIG. 29).

Looking at FIG. 29 which is a top view of the embodiment shown in FIG. 28, it can be seen that a series of bands 70 have a band left side 70*a* and a band right side 70*b* which can be seen from the top view and the opening defined by slot 14, which can only be see on the side view of FIG. 28 can receive the handle catch 91 to complete the loop in the fashion shown in the embodiment described in reference to FIG. 1. The main difference here is the use of a plastic band 70 which allows for a continuous stamped plastic type model to be used in place of individual loops.

In this case, it can be seen that the loop frame 81 has been divided into the handle body 1 and the loop frame 81.

One feature, best seen in FIG. 28, is having the handle body 1 and handle catch 91 with the band 70 being thinner.

Figure 30:
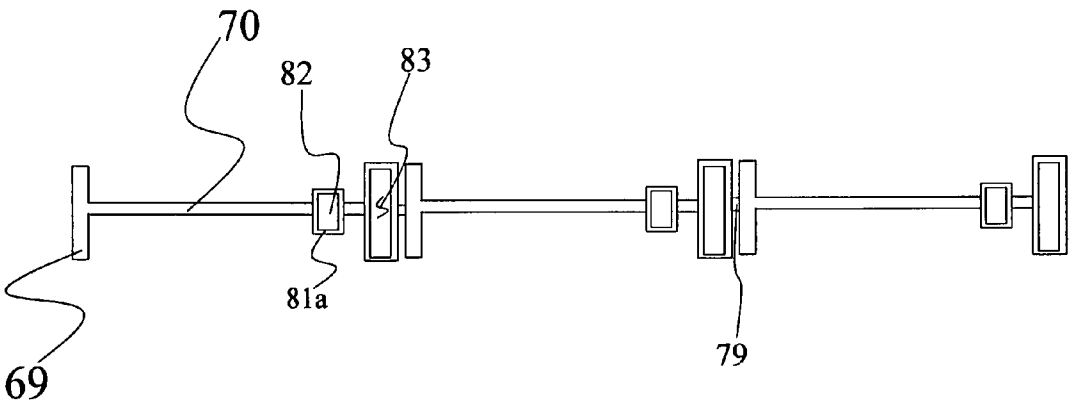
FIG. 30 shows a top view of an alternate embodiment of FIG. 29.

FIG. 30 shows an alternate embodiment to that shown in FIG. 29, where the two bands 70*a* and 70*b* have been replaced with a single band 70 but is otherwise in the same design.

In each of these designs, it may come out of a spool 92 (as shown in FIGS. 28 and 29) for them to be easily distributed sequentially.

Figure 31:
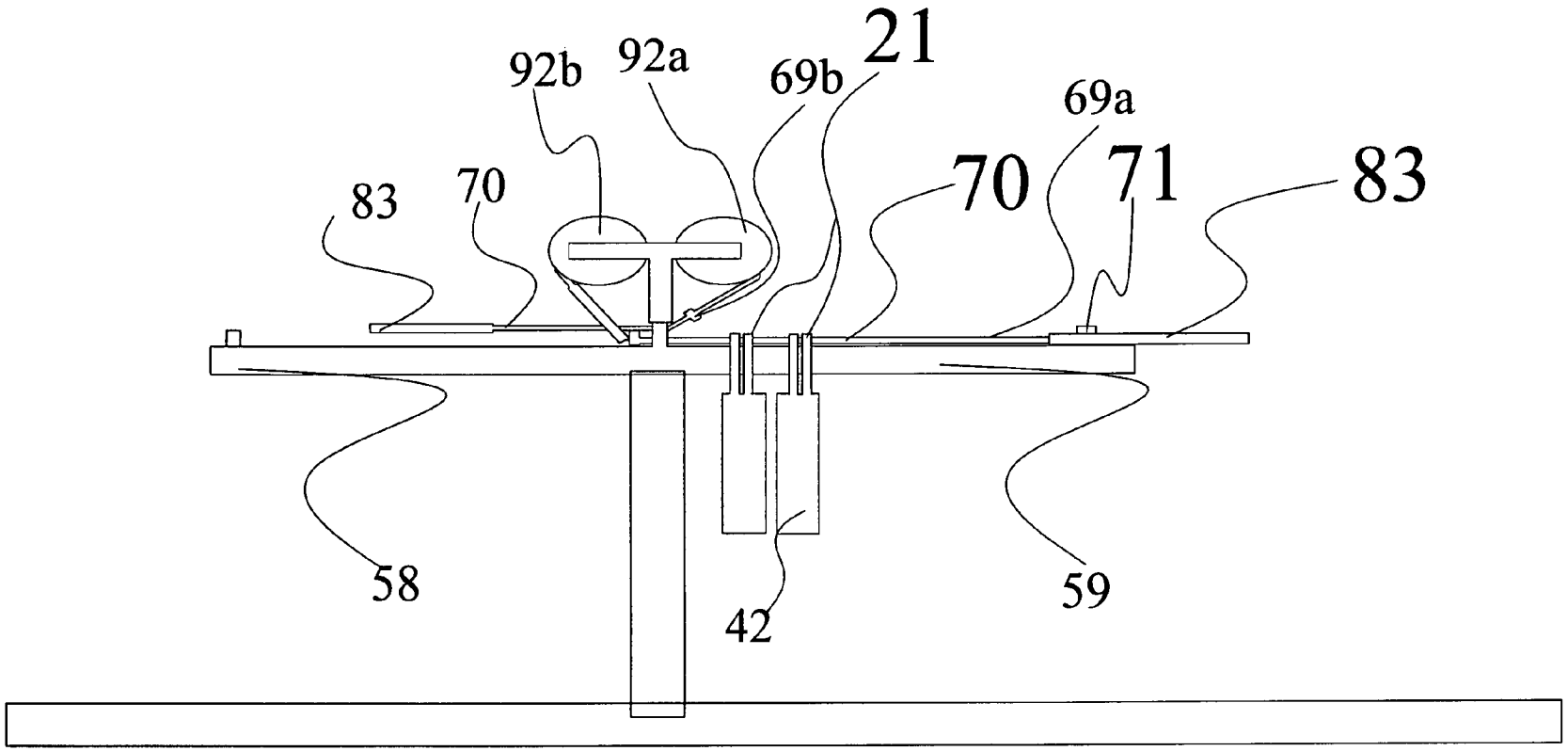
FIG. 31 shows a dispensing mechanism using one or more spools.
Figure 32:
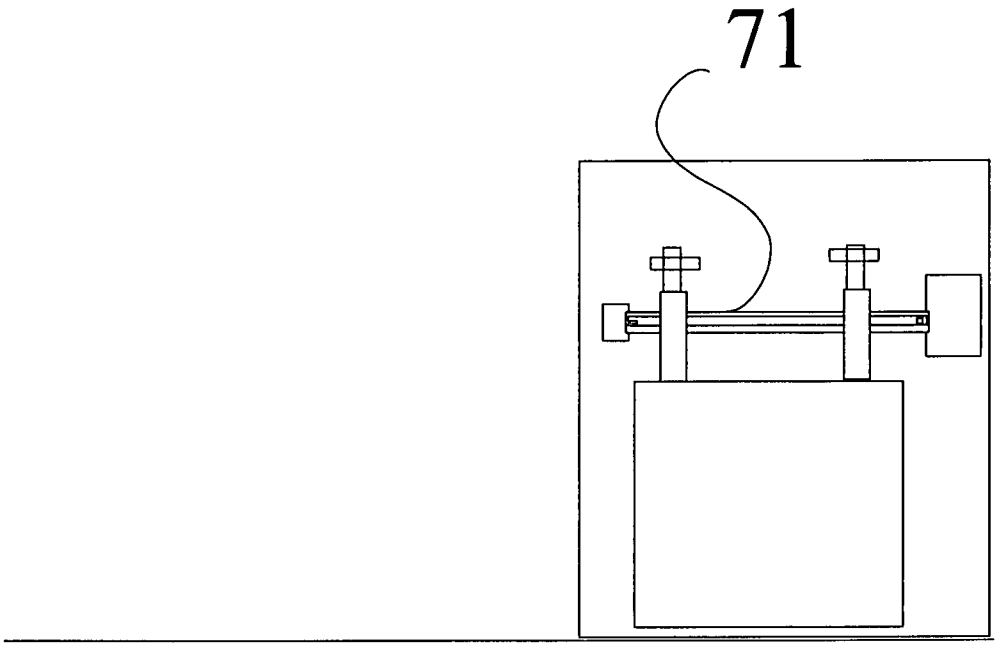
FIG. 32 shows a box which dispenses to the side of bags loaded on parallel rack arms.
Figure 34:
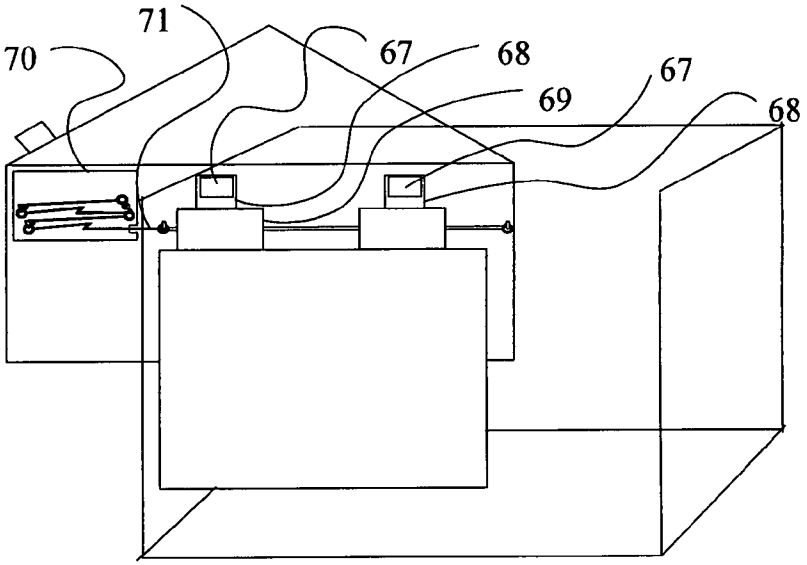
FIG. 34 shows a perspective view of the embodiment shown in FIG. 33.
Figure 33:
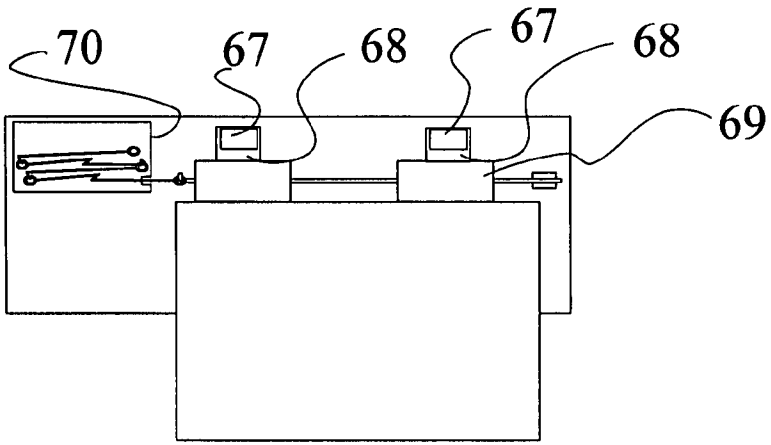
FIG. 33 shows an alternate to the embodiment in 32.
Figure 35:
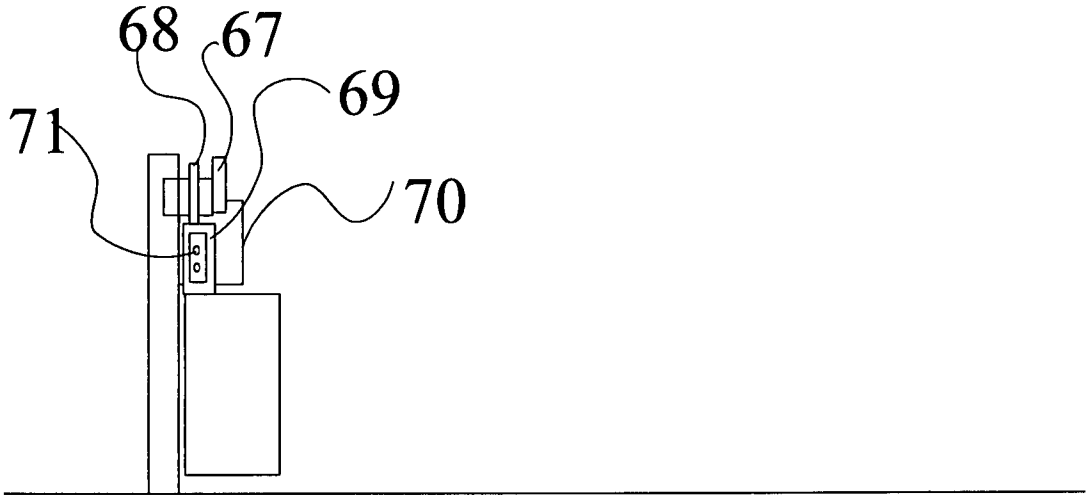
FIG. 35 shows a side view of the embodiment in FIG. 32.

FIG. 31 shows how one or more spools 92*a* and 92*b* dispensing the handles 69 together onto two arms 58 and 59 so that the devices can be sequentially loaded or unloaded off of a spool 92*a* and 92*b*. In order to hold them tight, in this case, the spools criss-cross so that the right handed spool goes to the left arm and the left handed spool goes to the right arm so they are held by the spools feeding them in either direction.

Another difference in the embodiment in FIG. 31, is that the handle 69 is dispensed on an opposite side from handle receiving hole 83. Here, the right side handle 69*a* is in place but the left handle 69*b* is not fully stretched over arm 58.

FIGS. 32-35 shows a handle 69 going through handle receiving hole 83 which is defined by loop frame 81. A stamped plastic handle 114 holding bags 42 by bag handles 21 with handle 69 instead through the handle receiving hole 83 in loop frame 81. In this embodiment, the handles are fed from the side.

Figure 36:
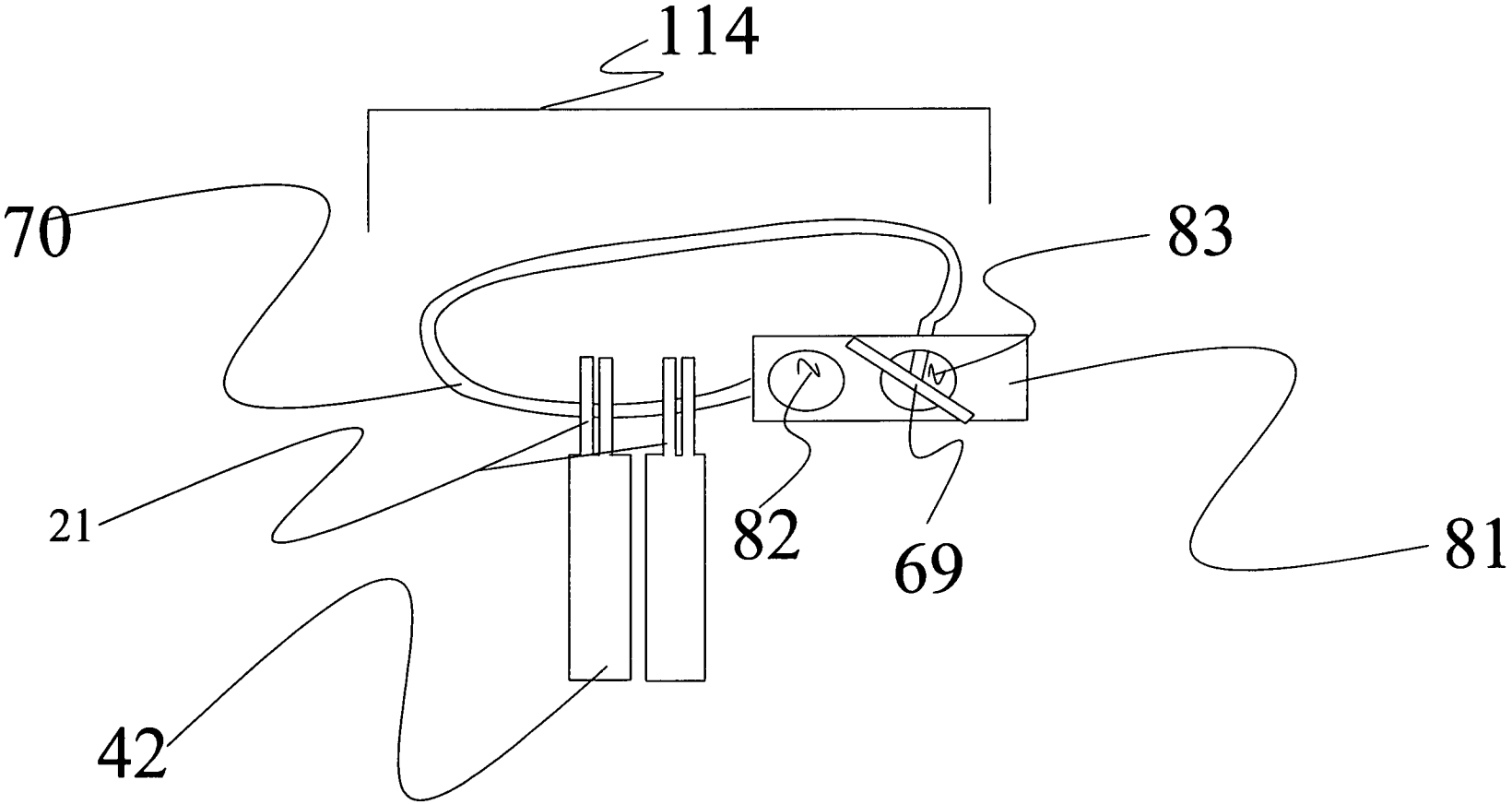
FIG. 36 shows a looped strap of the type taught herein holding bag handles.

FIG. 36 shows a looped strap 70 of a plastic handle 114 of the type taught herein holding bag handles 21 of bags 42. The loop is made by inserting the handle 69 into the handle receiving opening 83 in the loop frame 81.

Figure 37:
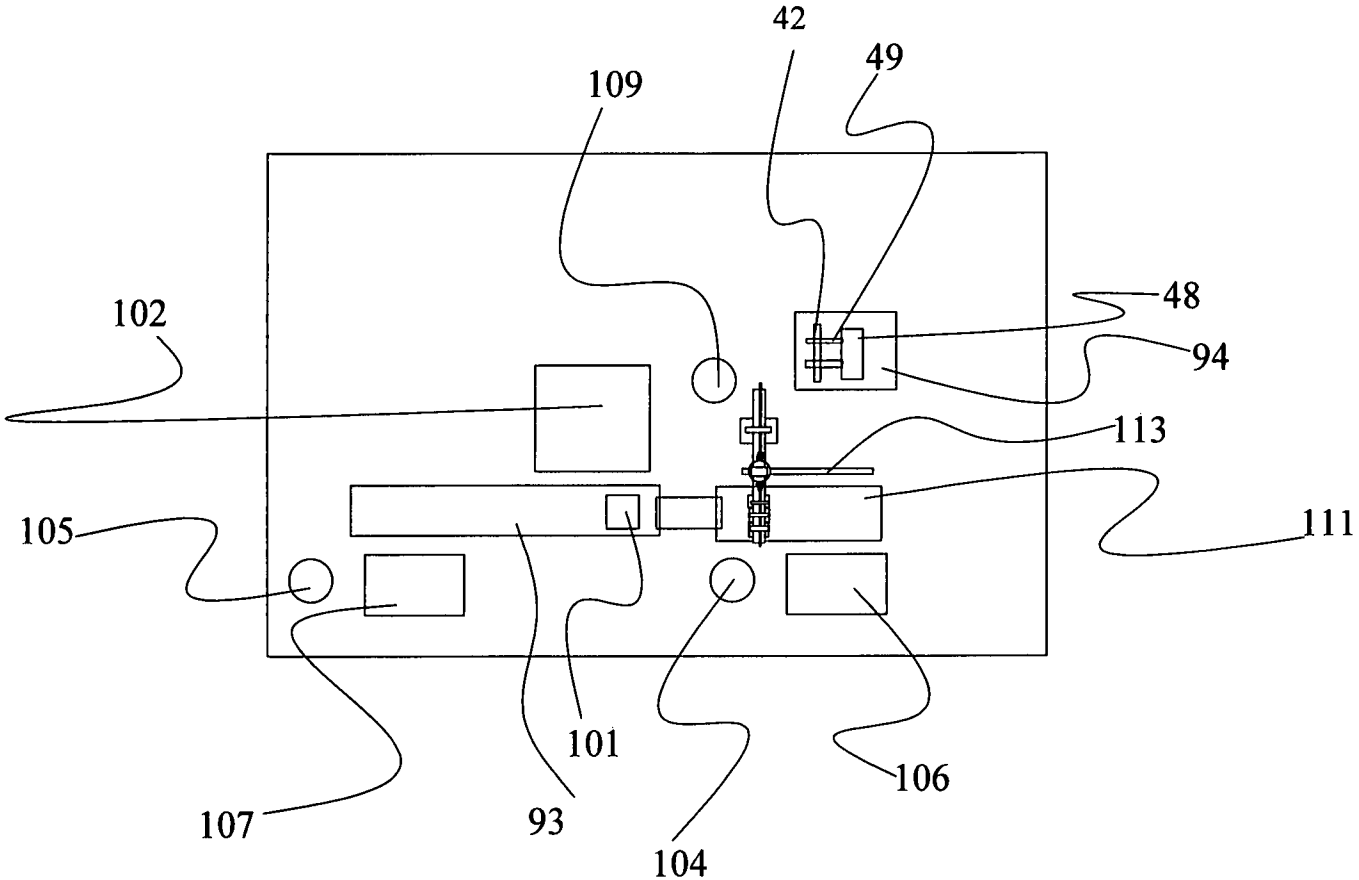
FIG. 37 shows the layout of a checkout line with users and the invention.
Figure 38:
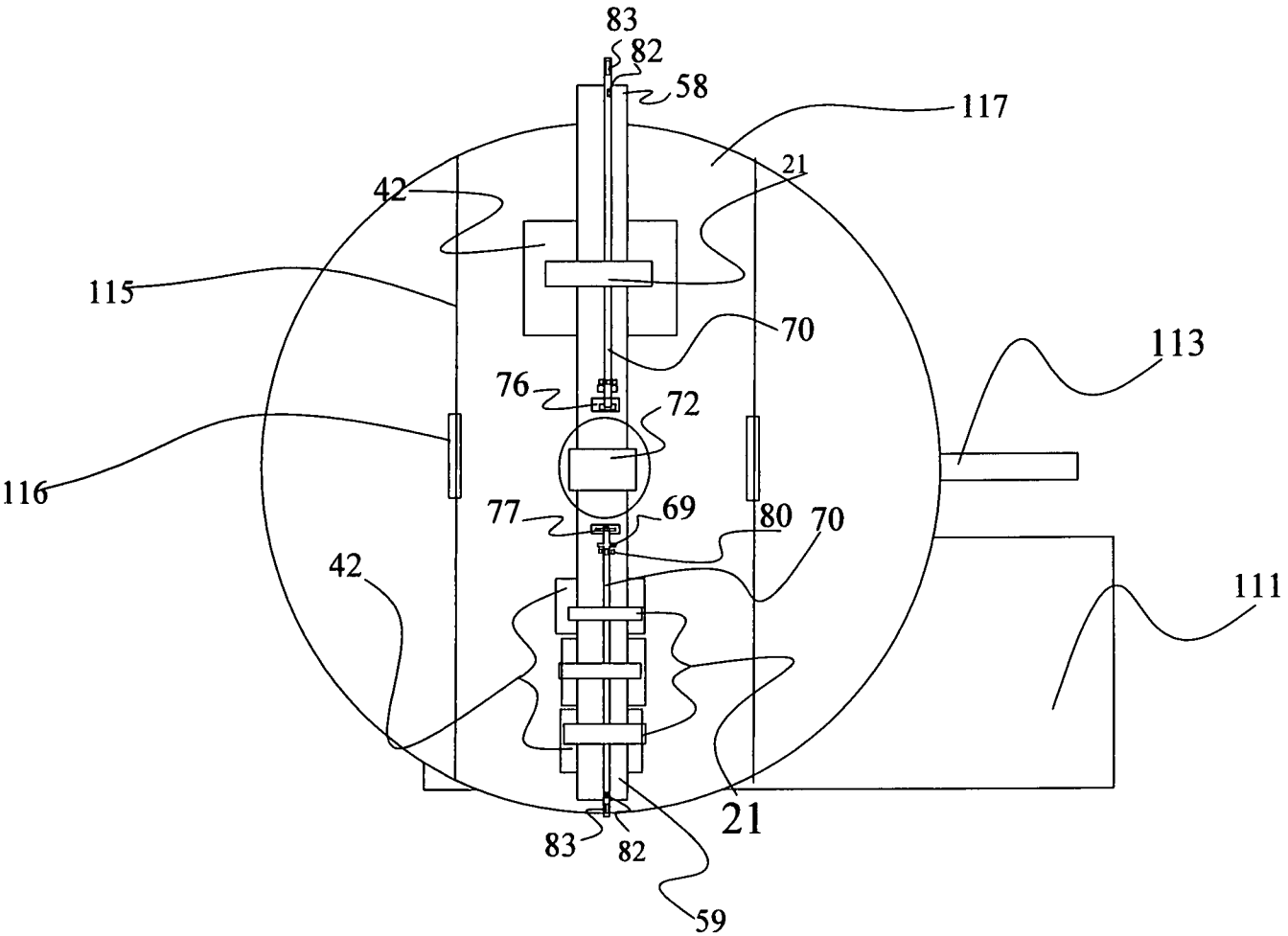
FIG. 38 shows is a closer view of the embodiment in FIG. 37

As can be seen by reference to FIGS. 37 and 38 the invention is best understood in place at a check out store with the bagging table 111 are three bags 42 held by six handles 21 (draw handles) on arms 59.

A user at user position 109 loaded bags 42 from rack 48 onto arm 59 and rotated the arm 59 over table 111. There is a single bag 42 in place over the band 70 mounted on arm 58, just as there were three bags mounted by six handles on arm 59.

As can be seen by this overhead view of FIG. 38, the handle 69 can be pulled up pulling out the next band and handle through the right opening 77 and inserted into handle receiving hole 83, thereby closing the bags and allowing the bags 42 under the second arm 59 to be placed into the basket 112.

A second customer at customer position two 105 with a separate basket position two 107 can be loaded at belt 93 their groceries, which will run to a scanner 101, at the end of the belt 93 in the manner known in the art.

In this way, the items can be rung up on register 102, bagged on the loading table 94 and loaded onto the rack arms 58 and 59.

Arrows 10 show that the rack arms 58 and 59 may swivel in this example, to swivel over the bagging table 111 and back to the position where user 109 may load them. If rack arms 58 and 59 only swivel 180 degrees, it will help prevent the subsequent bands 70 from being twisted, if the bands 70 comes from a box 78 on the floor (see FIG. 21).

In this case, there is a track 113 which allows the device to slide to the right for reasons which will be more obvious from the description of Figure.

Figure 39:
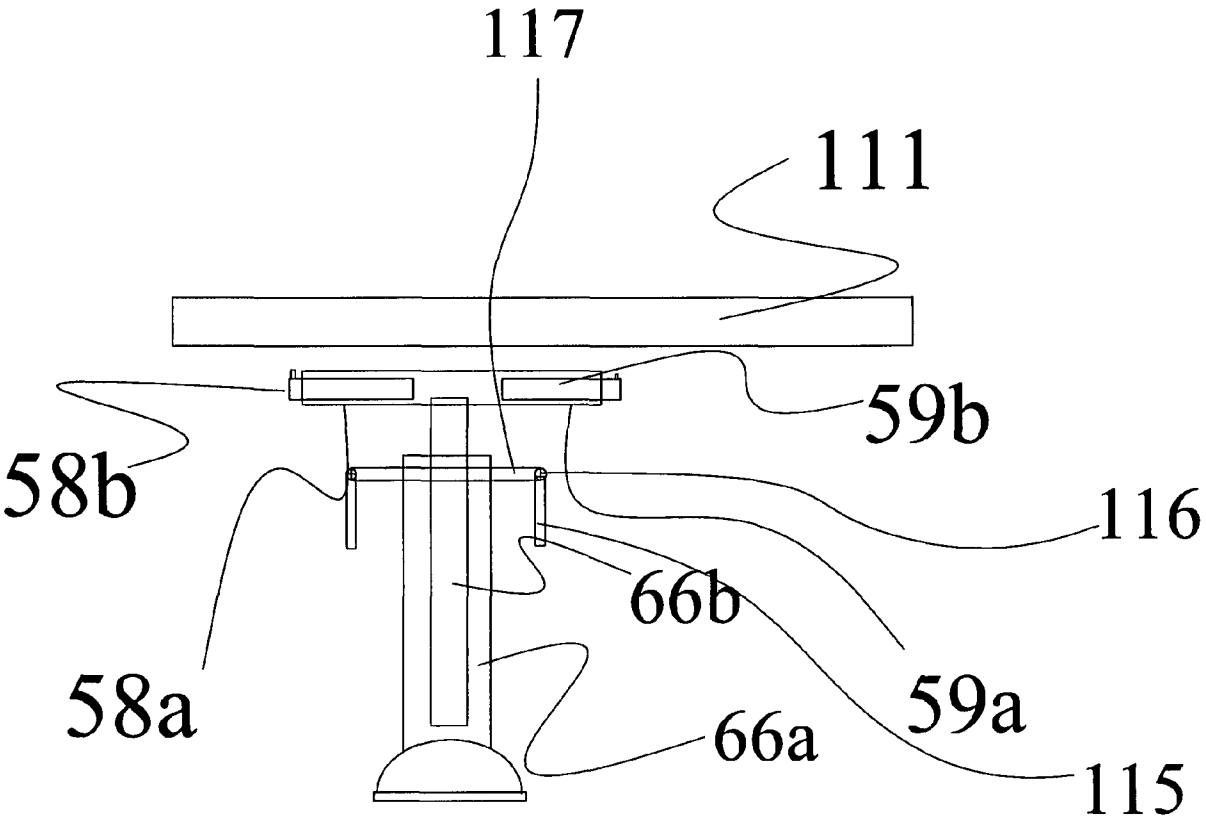
FIG. 39 shows the embodiment of FIG. 37 with a support plate and also shows how the invention uses hinges to reduce the size for easier storage.

FIG. 39 shows how the device may be made so that it has a first post 66*a* and a second post 66*b* as opposed to a single post 66 which allows for post 66*b* to retract into post 66*a* in order to lower the device below table 111.

Similarly there is a inner rack arm 58*a*, an outer rack arm 58*b* and an inner second rack arm 59*a* and an outer rack arm 59*b* which allow for the rack arms to be reduced in length by having one slide into the other so that the device may be folded up out of the way without removing it from its location at the register and on the track.

FIGS. 38 and 39 also show a support plate 117 which supports the bottom of bags 42 as they are held by bag handles 21 on the rack arms 58 and 59. The fold 115 and the plate 117 fold down around the hinge 116 as shown in FIG. 39 for storage.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

The invention claimed is:

1. A device for closing and joining bags having handles having a top and a bottom and a length from top to the bottom with a loaded width which device may be located proximately to a loading table and an unloading table comprising:

a) a plurality of strap means, a dispenser means for dispensing the plurality of strap means, each of said strap means comprising a first end and a second end and a strap length between the first end and second end and a closing means for closing a loop in the strap means between the first end and the second end, and b) further comprising a support means comprising at least one rack arm with a first front end and first rear end and an arm length between the first front end and the first rear end receiving at one time at least one strap length of the plurality of strap means between the at least one first end and at least one second end along the arm length and receiving at least one bag handle over the strap along the arm length.

2. The device of claim 1 wherein the support means further comprises at least one second rack arm with a second front end and second rear end and an arm length between the second front end and the second rear end receiving at least one of the plurality of strap means between the at least one second front end and at least one second rear end of the at least one second arm and receiving along the arm length above the strap length at least one second bag handle.

3. The device of claim 1 wherein the support means further comprises a base and wherein the at least one rack arm is above the base by at least the bag length.

4. The device of claim 3 wherein the spindle further comprise at least one bag support plate attached to the spindle and under the at least one rack arm and a distance less than the bag length.

5. The device of claim 1, wherein the support means further comprises a package holding means for holding and dispensing one of the plurality of strap means lengths between the first front end and first rear end.

6. The device of claim 5 wherein the strap means comprises a string having a first and second length and a handle attachable along the first length of the string.

7. The device of claim 5 wherein the support means further comprises a strap dispensing means at the rear end for sequentially dispensing a plurality of straps over the at least one rack arm.

8. The device of claim 7 wherein there is a strap dispensing means of the type described for each of a plurality of rack arms.

9. The device of claim 7 wherein the plurality of strap means sequentially feeds to the at least one rack arm from a spool means for holding straps to be fed sequentially.

10. The device of claim 9 wherein the plurality of straps are connected together by a connector.

11. The device of claim 2 wherein the support means further comprises a mounting means with a spindle for supporting the at least one rack arm first rear end and at least one second rack arm second rear end on the spindle so that the at least one rack arm is separated by a distance at least equal to the loaded width from the at least one second rack arm.

12. The device of claim 11 wherein the spindle rotates the rack arms between the loading table and the unloading table.

13. The device of claim 1 wherein the first rear end has a front and back and the at least one of the plurality of strap means comprises a handle.

14. The device of claim 13 wherein closing means comprises an opening defined by the strap approximately opposite the length from the handle for receiving the handle so the strap may be looped by inserting the handle into the opening.

15. The device of claim 1 wherein the invention comprises a user location adjacent to the support means and wherein the support means further comprises at least one rack means adjacent to the user location for holding bags while they are loaded before being moved to the at least one rack arm.

16. The device of claim 1 wherein the at least one rack arm defines a first holding means attached to the first front end for holding the strap first end with the strap length over the rack arm length between the first front end and the first rear end.

17. The device of claim 16 wherein the strap comprises a loop frame defining an opening and wherein the first holding means further holds the loop frame off of the rack arm.

18. The device of claim 16 wherein the at least one rack arm defines a second holding means attached to the first rear end for holding the strap second end at the first rear end.

* * * * *